US009761201B2

(12) United States Patent
Tanaka et al.

(10) Patent No.: US 9,761,201 B2
(45) Date of Patent: Sep. 12, 2017

(54) LIQUID-CRYSTAL DISPLAY DEVICE AND DRIVE METHOD THEREOF

(71) Applicant: Sharp Kabushiki Kaisha, Osaka-shi, Osaka (JP)

(72) Inventors: Noriyuki Tanaka, Osaka (JP); Takuya Sone, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 167 days.

(21) Appl. No.: 14/431,822

(22) PCT Filed: Aug. 6, 2013

(86) PCT No.: PCT/JP2013/071195
§ 371 (c)(1),
(2) Date: Mar. 27, 2015

(87) PCT Pub. No.: WO2014/050316
PCT Pub. Date: Apr. 3, 2014

(65) Prior Publication Data

US 2015/0248873 A1 Sep. 3, 2015

(30) Foreign Application Priority Data

Sep. 28, 2012 (EP) ..... 2012-217380

(51) Int. Cl.
*G09G 3/36* (2006.01)
*G09G 5/18* (2006.01)

(52) U.S. Cl.
CPC ..... *G09G 5/18* (2013.01); *G09G 3/3648* (2013.01); *G09G 2340/0435* (2013.01)

(58) Field of Classification Search
CPC ..... G09G 3/00–3/38; G09G 3/2096; G09G 3/3611; G09G 5/18; G09G 3/3614;
(Continued)

(56) References Cited

U.S. PATENT DOCUMENTS

2002/0093473 A1 7/2002 Tanaka et al.
2003/0020699 A1* 1/2003 Nakatani ..... G06F 3/1415 345/204

(Continued)

FOREIGN PATENT DOCUMENTS

CN 104094345 A 10/2014
JP 2002-278523 A 9/2002

(Continued)

*Primary Examiner* — Bryan Earles
(74) *Attorney, Agent, or Firm* — Keating & Bennett, LLP

(57) ABSTRACT

Provided are a liquid crystal display device and a drive method thereof, capable of promptly making an afterimage, which is visually recognized at refresh time, visually unrecognizable and reducing power consumption during and after a shift to a target refresh rate. At pause drive time until a target refresh rate is reached, a refresh is performed in divided periods of a first refresh period for performing a refresh at least twice, and a second refresh period for performing a refresh while increasing the number of frames in a non-refresh period from a refresh rate at the end of the first refresh period until the refresh rate becomes the target refresh rate, and the second refresh period is finished when the refresh rate in the second refresh period reaches the target refresh rate, and the pause drive is continued at the target refresh rate.

15 Claims, 15 Drawing Sheets

(58) Field of Classification Search
CPC ..... G09G 3/3648; G09G 2310/0278; G09G 2320/0252; G09G 2330/021; G09G 2340/0435; G09G 2360/18; G09G 2370/022
See application file for complete search history.

(56) References Cited

U.S. PATENT DOCUMENTS

| | | | | |
|---|---|---|---|---|
| 2004/0036669 | A1 | 2/2004 | Yanagi et al. | |
| 2009/0237391 | A1 | 9/2009 | Yanagi et al. | |
| 2011/0199404 | A1* | 8/2011 | Umezaki ..... | G09G 3/3648 345/691 |
| 2011/0205254 | A1* | 8/2011 | Umezaki ..... | G09G 3/3648 345/690 |
| 2014/0368484 | A1 | 12/2014 | Tanaka et al. | |

FOREIGN PATENT DOCUMENTS

| | | | |
|---|---|---|---|
| JP | 2004-078124 | A | 3/2004 |
| JP | 2009-229961 | A | 10/2009 |
| WO | 2008/015814 | A1 | 2/2008 |

* cited by examiner

HOST
DISPLAY PORTION
30Hz
20Hz
7.5Hz
4.62Hz
3.33Hz
2.61Hz
1.03Hz
1Hz
1Hz
R N R N N R N N N N N N R N N N N N N

30Hz
20Hz
1Hz
1Hz
R N N R N N N

LIQUID-CRYSTAL DISPLAY DEVICE AND DRIVE METHOD THEREOF

TECHNICAL FIELD

The present invention relates to a liquid crystal display device and a drive method thereof, and specifically relates to a liquid crystal display device that displays an image by pause drive, and a drive method thereof.

BACKGROUND ART

In recent years, small-sized lightweight electronic equipment has been under active development. A liquid crystal display device mounted in such electronic equipment has been required to consume low electric power. As one of drive methods for reducing power consumption of the liquid crystal display device, there is a drive method called "pause drive" provided with a drive period for scanning scanning lines to write a signal voltage and a pause period for bringing all scanning lines into a non-scanning state to make writing pause. In the pause drive, in the pause period, a controlling signal or the like is prevented from being given to a scanning line drive circuit and/or a data signal line drive circuit, to make pause operations of the scanning line drive circuit and/or the data signal line drive circuit, thereby attaining low power consumption of the liquid crystal display device. Such pause drive is also referred to as "low-frequency drive" or "intermittent drive".

For example, Japanese Patent Application Laid-Open No. 2004-78124 discloses that an operation of a clock signal generation circuit which generates a clock signal for taking a data signal into a signal line is halted, thereby reducing consumption power in a pause period.

PRIOR ART DOCUMENT

Patent Document

[Patent Document 1] Japanese Patent Application Laid-Open No. 2004-78124

SUMMARY OF THE INVENTION

Problems to be Solved by the Invention

In the pause drive, the larger the number of frames in the pause period is made, the more the power consumption can be reduced. For example, when a refresh rate is set to 1 Hz, the number of refresh frames is one and the number of non-refresh frames is 59, thus allowing significant reduction in power consumption. However, due to a reason described later, there occurs a problem that an afterimage is visually recognized for two seconds from the start of the first refresh to the end of the third refresh. As thus described, when the refresh rate is lowered, the number of times that the screen is refreshed per unit time decreases, and hence an afterimage is visually recognized for a long time.

A description will be given of the reason why such an afterimage is visually recognized at the pause drive time. First, there will be described a configuration of a pixel formation portion included in a display portion of the liquid crystal display device. Each pixel formation portion is provided with a thin-film transistor that functions as a switching element (Thin-Film Transistor: hereinafter referred to as "TFT"). A source terminal of the TFT is electrically connected to a signal line, a gate terminal thereof to a scanning line, and a drain terminal thereof to a pixel electrode, respectively. The pixel electrode forms a liquid crystal capacitance between itself and a common electrode that is commonly provided in all pixels. When a signal voltage (driving image signal) in accordance with image data is written into the liquid crystal capacitance from the signal line via the TFT, liquid crystal molecules are oriented in a direction corresponding to the signal voltage, and the liquid crystal display device displays an image represented by the image data.

The liquid crystal capacitance is generally expressed by the following expression when a liquid crystal dielectric constant is $\in$, an area of the facing surfaces of the pixel electrode and the common electrode is S and a distance between the pixel electrode and the common electrode is d.

$$Clc=\in\times S/d$$

This liquid crystal dielectric constant $\in$ has anisotropy, and its value varies depending on the orientation direction of the liquid crystal molecules. Further, since a liquid crystal transmittance is controlled by the orientation direction of the liquid crystal molecules, the liquid crystal dielectric constant $\in$ varies depending on a tone.

FIG. 14 is one example of a timing chart showing normal drive in a conventional liquid crystal display device. As shown in FIG. 14, a positive polarity voltage and a negative polarity voltage for performing white display are alternately applied to the liquid crystal capacitance in every scanning period. In a first scanning period, when the positive polarity voltage is applied to the liquid crystal capacitance, the liquid crystal molecules are orientated so as to come close to a direction corresponding to the applied voltage. However, the liquid crystal capacitance does not reach a capacitance (dashed line in the drawing) required for the white display, and the applied voltage of the liquid crystal capacitance does not reach a voltage Va required for the white display. Then in the second drive frame and drive frames thereafter, by applying the voltage required for the white display, the liquid crystal capacitance reaches the capacitance required for the white display, and the applied voltage reaches the voltage Va required for the white display.

Next, conventional pause drive will be described. FIG. 15 is one example of a timing chart showing first pause drive in the conventional liquid crystal display device. As shown in FIG. 15, just one frame period is provided as the scanning period. In this scanning period, a negative polarity voltage is applied to the liquid crystal capacitance for performing white display, and periods thereafter are pause periods. The liquid crystal molecules are orientated so as to come close to a direction corresponding to the voltage applied in the scanning period. However, since the orientation direction of the liquid crystal molecules cannot sufficiently change as following the applied voltage within a writing period, a change in liquid crystal capacitance is delayed as compared to a change in applied voltage. For this reason, the liquid crystal capacitance at the end of the writing period cannot reach the capacitance (dashed line in the drawing) required for the white display. As a result, the applied voltage also does not reach the voltage Va required for the white display, but only reaches a voltage Vb lower than that. A difference between the voltages Va and Vb causes an afterimage to be visually recognized on the screen.

Accordingly, an object of the present invention is to provide a liquid crystal display device and a drive method thereof, capable of promptly making an afterimage, which is visually recognized at pause drive time, visually unrecognizable and reducing power consumption during and after a shift to a target refresh rate.

Means for Solving the Problems

According to a first aspect of the present invention, there is provided a liquid crystal display device which performs pause drive at a target refresh rate, the device including:

a display portion including a plurality of pixel formation portions;

a drive portion for driving the display portion; and display control portion for controlling the drive portion based on data received from the outside, wherein, at pause drive time until a target refresh rate is reached, a refresh is performed in divided periods of a first refresh period for performing a refresh at least twice, and a second refresh period for performing a refresh while increasing the number of frames in a non-refresh period from a refresh rate at the end of the first refresh rate until the refresh rate becomes the target refresh rate, and the second refresh period is finished when the refresh rate in the second refresh period reaches the target refresh rate, and the pause drive is continued at the target refresh rate.

According to a second aspect of the present invention, in the first aspect of the present invention, wherein an amount of change in number of non-refresh frames in the second refresh period is larger than an amount of change in number of non-refresh frames in the first refresh period.

According to a third aspect of the present invention, in the second aspect of the present invention, wherein the number of times of refreshes that are performed in the second refresh period is more than one.

According to a fourth aspect of the present invention, in the third aspect of the present invention, wherein the number of frames in the non-refresh period in the second refresh period is increased in arithmetic progression with a common difference of not smaller than 2.

According to a fifth aspect of the present invention, in the third aspect of the present invention, wherein the number of frames in the non-refresh period in the second refresh period is increased in geometric progression with a common ratio of not smaller than 2.

According to a sixth aspect of the present invention, in the second aspect of the present invention, wherein the number of times of refreshes that are performed in the second refresh period is one, and the one refresh is performed at the same refresh rate as the target refresh rate.

According to a seventh aspect of the present invention, in the first aspect of the present invention, wherein the number of times of refreshes in the first refresh period is at least two, and at least one non-refresh frame is provided in a non-refresh period between each of the refreshes.

According to an eighth aspect of the present invention, in the seventh aspect of the present invention, wherein the number of non-refresh frames in the first refresh period is increased in every non-refresh period in arithmetic progression with a common difference of not smaller than 1.

According to a ninth aspect of the present invention, in the seventh aspect of the present invention, wherein the number of non-refresh frames in each non-refresh period in the first refresh period is the same.

According to a tenth aspect of the present invention, in the first aspect of the present invention, wherein, the display control portion performs control for Alternating Current (AC) drive, and in a whole period of the first refresh period and the second refresh period, a positive polarity period made up of a refresh period for performing a refresh with positive polarity and a non-refresh period immediately after the refresh period and a negative polarity period made up of a refresh period for performing a refresh with negative polarity and a non-refresh period immediately after the refresh period are provided in approximately the same proportion.

According to an eleventh aspect of the present invention, in the first aspect of the present invention, wherein the display control portion stops a refresh and a refresh pause when receiving the updated data within the first or second refresh period, and newly performs a refresh from the first refresh period by use of the updated data.

According to a twelfth aspect of the present invention, in the eleventh aspect of the present invention, wherein the data is data irregularly received by the display control portion from the outside.

According to a thirteenth aspect of the present invention, in the eleventh aspect of the present invention, wherein the data is data regularly received from the outside in a predetermined cycle.

According to a fourteenth aspect of the present invention, in the first aspect of the present invention, wherein the pixel formation portion includes a thin-film transistor having a control terminal connected to a scanning line in the display portion, a first conduction terminal connected to a signal line in the display portion, a second conduction terminal connected to a pixel electrode in the display portion, which is to be applied with a voltage in accordance with an image to be displayed, and a channel layer formed of an oxide semiconductor.

According to a fifteenth aspect of the present invention, in the fourteenth aspect of the present invention, wherein the oxide semiconductor is InGaZnOx mainly composed of indium (In), gallium (Ga), zinc (Zn) and oxygen (O).

According to a sixteenth aspect of the present invention, there is provided a method for driving a liquid crystal display device which includes a display portion including a plurality of pixel formation portions, a drive portion for driving the display portion, and a display control portion for controlling the drive portion based on data received from the outside, the device performing pause drive at a target refresh rate, the method including the steps of:

performing a refresh at least twice in a first refresh period at pause drive time until a target refresh rate is reached;

performing a refresh while increasing the number of frames in a non-refresh period until the refresh rate becomes the target refresh rate in a second refresh period after the end of the first refresh period; and finishing the second refresh period when the refresh rate in the second refresh period reaches the target refresh rate, to continue the pause drive at the target refresh rate.

According to a seventeenth aspect of the present invention, in the sixteenth aspect of the present invention, wherein the step of performing a refresh in the second refresh period is performing a refresh such that an amount of change in number of non-refresh frames in the second refresh period becomes larger than an amount of change in number of non-refresh frames in the first refresh period.

Effects of the Invention

According to the first aspect of the present invention, the refresh rate in the second refresh period is changed more quickly than the refresh rate in the first refresh period. Hence it is possible to finish in a short time the first refresh period for performing a refresh required for making an afterimage, which is visually recognized at pause drive time, visually unrecognizable, and reach the target refresh rate for the pause drive more quickly while lowering the refresh rate in stages. As a result, it is possible to promptly make an afterimage visually unrecognizable after the first refresh is performed in the first frame. Further, it is possible to make a shift to the target refresh rate for the pause drive in a short time, so as to reduce the number of times of refreshes during and after the shift to the target refresh rate. Hence it is possible to reduce the power consumption of the liquid crystal display device in this period.

According to the second aspect of the present invention, since the amount of change in number of non-refresh frames in the second refresh period is larger than the amount of change in number of non-refresh frames in the first refresh period, it is possible to make a shift to the target refresh rate for the pause drive in a short time.

According to the third aspect of the present invention, by performing a plurality of times of refreshes in the second refresh period, it is possible to reach the target refresh rate for the pause drive in a short time while suppressing deterioration in display quality of the image. Hence it is possible to reduce the power consumption of the liquid crystal display device from the start of the pause drive until the reach to the target refresh rate.

According to the fourth aspect of the present invention, it is possible to increase the number of frames in every non-refresh period in the second refresh period in arithmetic progression with a common difference of not smaller than 2, so as to reach the target refresh rate more quickly while lowering the refresh rate in stages. Hence it is possible to reduce the power consumption of the liquid crystal display device from the start of the pause drive until the reach to the target refresh rate.

According to the fifth aspect of the present invention, it is possible to increase the number of frames in every non-refresh period in the second refresh period in geometric progression with a common ratio of not smaller than 2, so as to reach the target refresh rate further more quickly while lowering the refresh rate in stages. Hence it is possible to further reduce the power consumption of the liquid crystal display device from the start of the pause drive until the reach to the target refresh rate.

According to the sixth aspect of the present invention, in the second refresh period, the refresh rate is not changed in stages, but is lowered straight to the target refresh rate for the pause drive. Thereby it is possible to reach the target refresh rate in the shortest time, and reduce the number of times of refreshes during and after the shift to the target refresh rate. Hence it is possible to significantly reduce the power consumption of the liquid crystal display device in this period.

According to the seventh aspect of the present invention, since a refresh is performed at least twice in the first refresh period, it is possible to make an afterimage visually unrecognizable in the pause drive. Further, at least one non-refresh frame is provided in the non-refresh period between each of the refreshes. Hence it is possible to realize effective pause drive with respect to each of data inputted from the outside with a variety of frequencies.

According to the eighth aspect of the present invention, since the number of non-refresh frames in the non-refresh period in the first refresh period is increased in arithmetic progression with a common difference of 1, it is possible to finish the first refresh period in a short time. Hence it is possible to make an afterimage at the pause drive time visually unrecognizable in a short time.

According to the ninth aspect of the present invention, since the number of non-refresh frames in each non-refresh period in the first refresh period is the same, it is possible to finish the first refresh period in a short time as in the case of the seventh aspect of the present invention. Hence it is possible to make an afterimage at the pause drive time visually unrecognizable in a short time.

According to the tenth aspect of the present invention, throughout the first and second refresh periods, a positive polarity period made up of a refresh period for performing a refresh with positive polarity and a non-refresh period immediately after the refresh period and a negative polarity period made up of a refresh period for performing a refresh with negative polarity and a non-refresh period immediately after the refresh period are set in approximately the same proportion, and hence the liquid crystal layer is AC-driven at a favorable polarity balance. Hence it is possible to suppress deterioration in liquid crystal layer.

According to the eleventh aspect of the present invention, when the updated data is received within the first or second refresh period, a refresh is performed from the first refresh period by use of the updated data. Thereby, when the data is updated, the screen on the display portion is also immediately refreshed, and the updated image can be displayed.

According to the twelfth aspect of the present invention, a refresh is performed by use of data that is irregularly received from the outside, thereby achieving a similar effect to the effect by the first aspect of the present invention.

According to the thirteenth aspect of the present invention, a refresh is performed by use of data that is regularly received from the outside in a predetermined cycle, thereby achieving a similar effect to the effect by the first aspect of the present invention.

According to the fourteenth aspect of the present invention, the thin-film transistor in which the channel layer is formed of an oxide semiconductor is used as the thin-film transistor in the pixel formation portion. In such a thin-film transistor, a leak current decreases, and hence it is possible to hold a voltage written into the pixel formation portion at a sufficient level over a long time. Thereby, a change in display luminance becomes smaller, thus allowing further suppression of deterioration in display quality.

According to the fifteenth aspect of the present invention, by use of InGaZnOx as the oxide semiconductor that forms the channel layer, it is possible to reliably achieve the effect by the fourteenth aspect of the present invention.

According to the sixteenth aspect of the present invention, a similar effect to the effect by the first aspect of the present invention is achieved.

According to the seventeenth aspect of the present invention, a similar effect to the effect by the sixteenth aspect of the present invention is achieved.

MODES FOR CARRYING OUT THE INVENTION

1. Basic Consideration

1.1 First Basic Consideration

Figure 1:
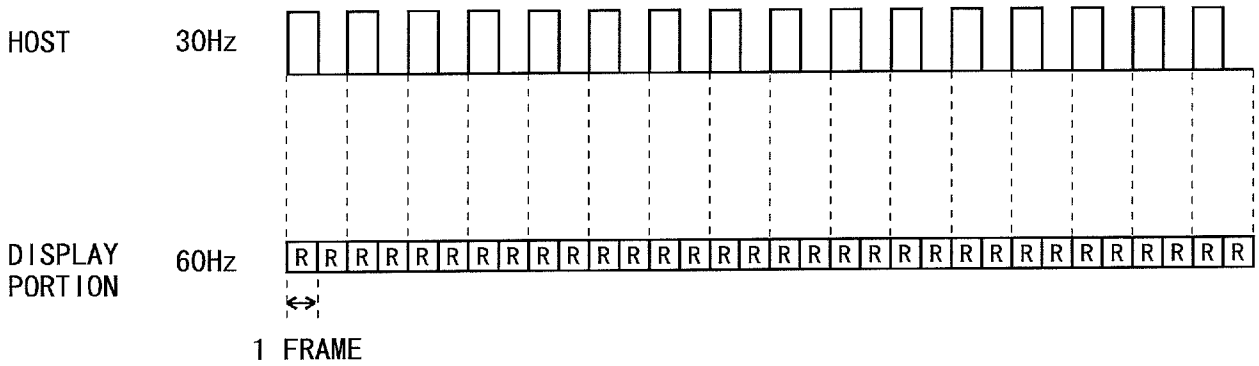
FIG. 1 is a diagram for explaining a refresh operation of a liquid crystal display device at the time of image data being updated at 30 Hz in a first basic consideration.
Figure 2:
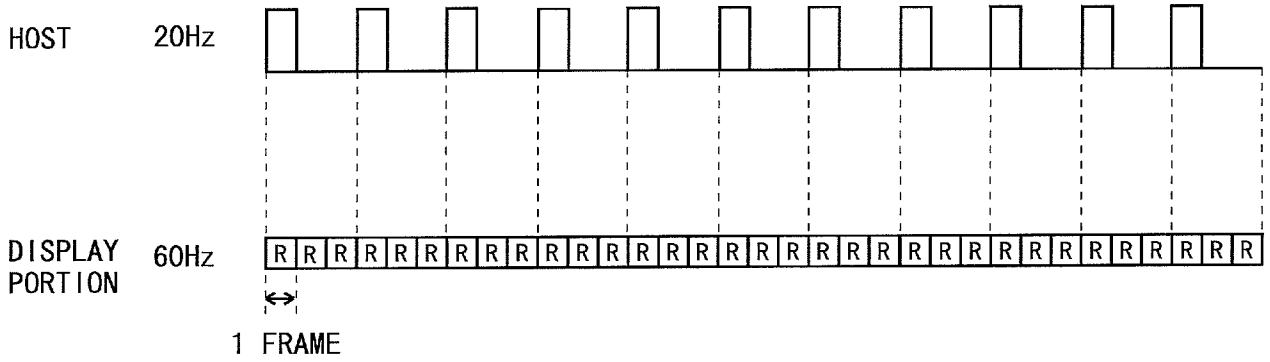
FIG. 2 is a diagram for explaining a refresh operation of the liquid crystal display device at the time of image data being updated at 20 Hz in the first basic consideration.

FIG. 1 is a diagram for explaining a refresh operation of a liquid crystal display device at the time of image data being updated at 30 Hz, and FIG. 2 is a diagram for explaining a refresh operation of the liquid crystal display device at the time of image data being updated at 20 Hz. It is to be noted that each rectangular box in each drawing described later shows one frame, a refresh frame for performing a refresh is provided with "R", and a non-refresh frame for making a refresh pause is provided with "N".

First, with reference to FIG. 1, a description will be given of a case where image data updated at 30 Hz is transmitted from a host. In this case, image data is updated once every two frames. In order to make an afterimage, which is caused by anisotropy of a liquid crystal dielectric constant, visually unrecognizable, it is preferable that upon the reception of such image data, a display control circuit not only perform the first refresh in the first frame by use of the updated image data but further perform a refresh in the second and third frames by use of the same image data, thereby performing a refresh three times in total. Therefore, the second refresh is performed using the second frame where a refresh has been scheduled to pause. However, when a third refresh is about to be performed in the third frame, updated image data is transmitted from the host.

Then, without performing the third refresh in the third frame, the display control circuit performs the first refresh by use of the updated image data, and further performs the second refresh in the fourth frame by use of the same image data. However, when a third refresh is about to be performed in the fifth frame, further updated image data is transmitted from the host. Therefore, without performing the third refresh in the fifth frame, the display control circuit performs the first refresh by use of the updated image data, and performs the second refresh in the sixth frame by use of the same image data.

Hereinafter, in a similar manner, a refresh is performed in an odd-numbered frame by use of image data transmitted from the host, and a refresh is performed in an even-numbered frame by use of the same image data as in the odd-numbered frame immediately therebefore. As a result, an image refreshed in all the frames is displayed on a display portion of the liquid crystal display device even though the image data is being updated once every two frames. That is, it follows that the liquid crystal display device is being operated at 60 Hz even though the host is being operated at 30 Hz, and hence the power consumption of the liquid crystal display device cannot be reduced by this drive method.

Next, with reference to FIG. 2, a description will be given of a case where image data updated at 20 Hz is transmitted from the host. In this case, image data is updated once every three frames. In order to make an afterimage, which is caused by anisotropy of a liquid crystal dielectric constant, visually unrecognizable, upon the reception of such image data, the display control circuit performs the first refresh in the first frame by use of the updated image data, and thereafter performs the second and third refreshes by use of the same image data. The second and third refreshes are respectively performed using the second and third frames where a refresh has been scheduled to pause.

When the third refresh is finished, updated image data is transmitted from the host. Then, the display control circuit performs the first refresh in the fourth frame by use of the updated image data, and thereafter, it further performs the second and third refreshes by use of the same image data. The second and third refreshes are respectively performed using the fifth and sixth frames where a refresh has been scheduled to pause.

Hereinafter, in a similar manner, the first refresh is performed when image data is transmitted, and subsequently, the second and third refreshes are performed. When the third refresh is finished, updated image data is transmitted from the host, and hence a refresh is performed three times by use of the updated image data. As a result, an image refreshed in all the frames is displayed on the display portion of the liquid crystal display device even though the image data is being updated once every three frames. That is, it follows that the liquid crystal display device is being operated at 60 Hz even though the host is being operated at 20 Hz, and hence the power consumption of the liquid crystal display device cannot be reduced by this drive method.

As thus described, by performing a refresh twice or three times by use of image data updated at 30 Hz or 20 Hz, an afterimage caused by anisotropy of a liquid crystal dielectric constant can be reduced or made visually unrecognizable, but the power consumption of the liquid crystal display device cannot be reduced, which is problematic.

1.2 Second Basic Consideration

An electric charge, with which the liquid crystal capacitance is charged, leaks via the TFT as a leak current with passage of time, and in association with this, a voltage of the liquid crystal capacitance decreases. For example, when the refresh rate is 60 Hz, since a period in which the liquid crystal capacitance is to hold a voltage is relatively short, an amount of a leak current is small and a decrease in voltage is small. However, when the refresh rate is 1 Hz, since a period in which the liquid crystal capacitance is to hold a voltage is relatively long, an amount of a leak current is large and a decrease in voltage is large. For this reason, the voltages of the liquid crystal capacitance in the case of the refresh rate being 60 Hz and in the case of it being 1 Hz, which are supposed to be the same, become different. For example, when the refresh rate is switched from 60 Hz to 1 Hz, even when the same image is to be displayed, its display luminance greatly changes, leading to deterioration in display quality. Therefore, after the end of the first refresh period as a refresh period for making an afterimage visually unrecognizable, the second refresh period for reducing the refresh rate in stages is provided so as to lessen the change in display luminance. Then in the second refresh period, when the refresh rate reaches the target refresh rate for the pause drive, the second refresh period is finished, and the pause drive is performed at the target refresh rate.

Figure 3:
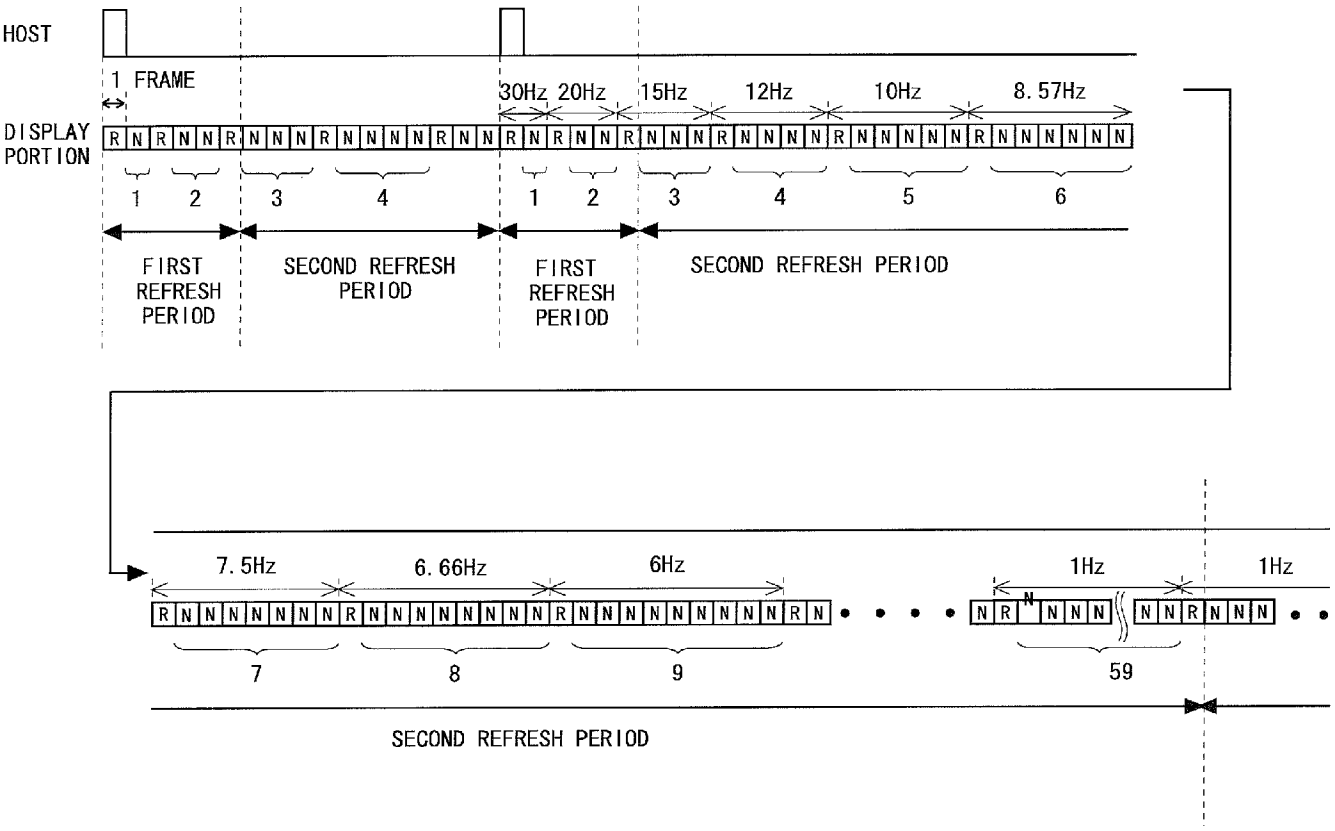
FIG. 3 is a diagram for explaining an operation of the liquid crystal display device until a target refresh rate for pause drive is reached while the number of frames is increased by one in every period for making a refresh pause at the time when the image data is updated in the first basic consideration.

FIG. 3 is a diagram for explaining an operation of the liquid crystal display device until 1 Hz as the target refresh rate for the pause drive is reached while the number of frames is increased by one in every period for making a refresh pause at the time when the image data is updated. Differently from the case of the first basic consideration, the updated image data shown in FIG. 3 is irregularly transmitted from the host. Further, in FIG. 3, the liquid crystal display device is provided with an auto-refresh function in which, when newly updated image data is transmitted during the time from the start of a refresh at a refresh rate of 30 Hz until the reach to 1 Hz as the target refresh rate for the pause drive, the refresh having been performed up to then is stopped, and a refresh at a refresh rate of 30 Hz is restarted by use of the newly updated image data.

It is to be noted that, although the updated image data is transmitted twice in FIG. 3, hereinafter, a description of the case of performing a refresh by use of initially transmitted image data will be omitted, and a description will be given from the time when the refresh is restarted at the refresh rate of 30 Hz by use of the image data transmitted for the second time. Further, a frame for performing the first refresh by use of the image data transmitted for the second time will be referred to as the first frame, and frames subsequent thereto will be sequentially referred to as the second frame and third frames.

When receiving the updated image data, the liquid crystal display device performs the first refresh by use of an image updated in the first frame, and makes a refresh pause in the second frame. It performs the second refresh in the third frame, and makes a refresh pause in the fourth and fifth frames. It performs the third refresh in the sixth frame, and makes a refresh pause in three frames from the seventh to ninth frames. Hereinafter, in a similar manner, there is made a repetition of performing a refresh, thereafter providing a non-refresh period, and increasing the number of non-refresh frames by one, to perform a refresh until the number of frames in the non-refresh period becomes 59. Accordingly, the refresh rate reaches 1 Hz as the target refresh rate for the pause drive. Thereafter, there is performed pause drive in which a refresh is repeated at 1 Hz until new image data is transmitted from the host.

In this case, the liquid crystal molecules can be oriented in a direction corresponding to the applied voltage by a total of three times of refreshes respectively performed in the first, third and sixth frames, and hence in pause drive thereafter, an afterimage can be made visually unrecognizable. This period from the first to sixth frames is referred to as a first refresh period. Further, in the seventh frame and frames thereafter, while the number of non-refresh frames in the non-refresh period is increased by one frame, a refresh is performed in each time. Thereby, the display luminance of the image changes in stages, and it is thus possible to prevent deterioration in display quality. A period from the seventh frame until the refresh rate reaches 1 Hz as the target refresh rate is referred to as a "second refresh period". As thus described, the second frame period in the present specification is a period in which a refresh is performed while the number of non-refresh frames is increased from a non-refresh frame subsequent to the refresh frame at the end of the first refresh period until the target refresh rate is reached.

In a general liquid crystal display device with a refresh rate being 60 Hz, when it is considered that one frame period is 16.67 msec, a very long time of about 28 seconds is required from the start of a refresh in the first frame until the reach to 1 Hz as the target refresh rate, which is problematic.

From the above first and second basic considerations, it is found necessary that the period from the performance of a refresh in the first frame until the refresh rate reaches 1 Hz is divided into the first refresh period for making an afterimage visually unrecognizable at the pause drive time and the second refresh period for lessening a change in display luminance by changing the refresh rate in stages, and a refresh is performed at a refresh rate corresponding to each period.

Then, with respect to the attached drawings, first to fourth embodiments of the present invention will be sequentially described.

2. First Embodiment

2.1 Configuration and Operation Summary of Liquid Crystal Display Device

Figure 4:
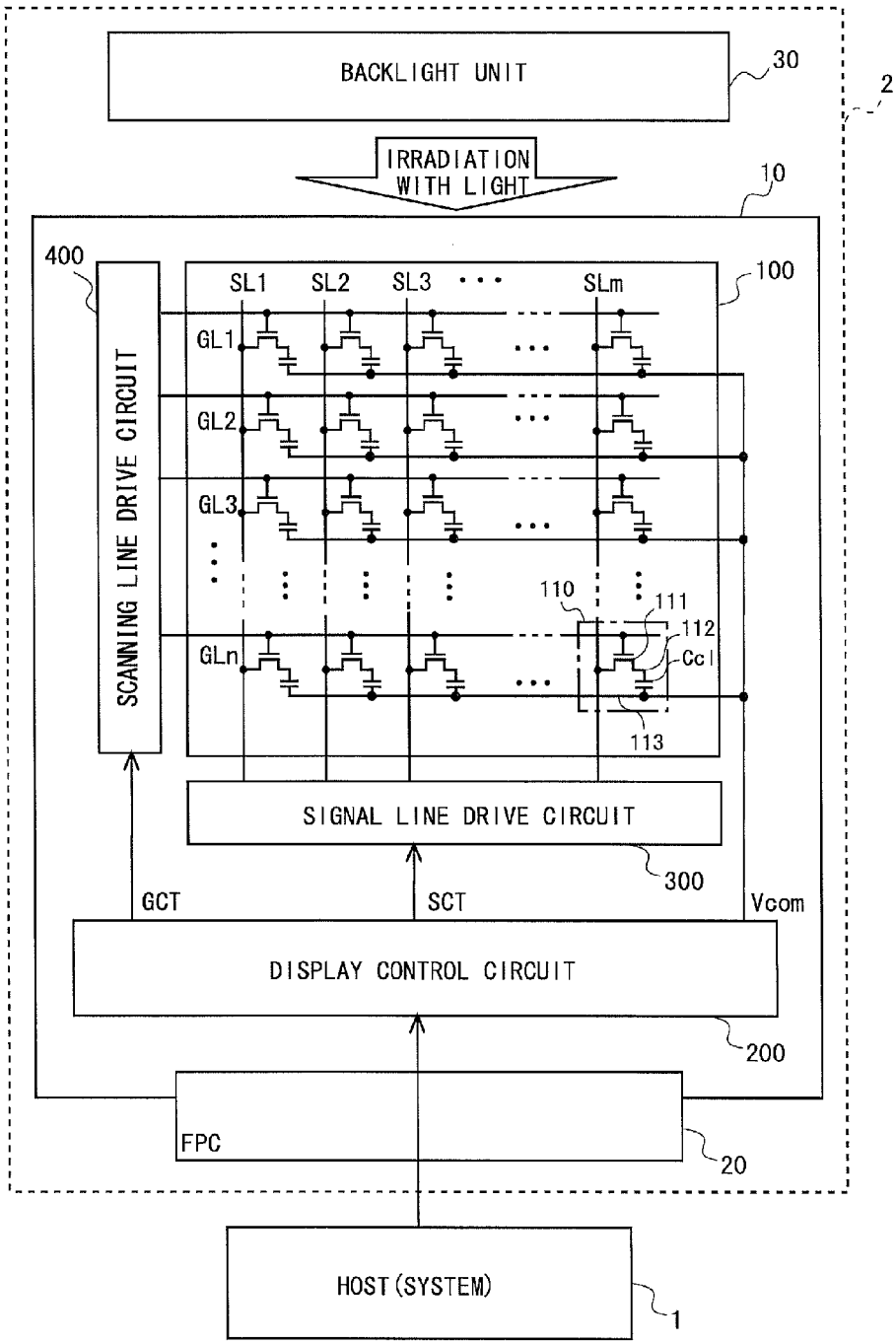
FIG. 4 is a block diagram showing a configuration of a liquid crystal display device according to a first embodiment of the present invention.

FIG. 4 is a block diagram showing a configuration of a liquid crystal display device 2 according to a first embodiment of the present invention. As shown in FIG. 4, the liquid crystal display device 2 is provided with a liquid crystal display panel 10 and a backlight unit 30. The liquid crystal display panel 10 is provided with an FPC (Flexible Printed Circuit) 20 for connection with the outside. Further, a display portion 100, a display control circuit 200, a signal line drive circuit 300 and a scanning line drive circuit 400 are provided on the liquid crystal display panel 10. It is to be noted that both or either one of the signal line drive circuit 300 and the scanning line drive circuit 400 may be provided in the display control circuit 200. Further, both or either one of the signal line drive circuit 300 and the scanning line drive circuit 400 may be formed integrally with the display portion 100. A host 1 (system) configured mainly of a CPU is provided outside the liquid crystal display device 2.

The display portion 100 is formed with a plurality of (m) signal lines SL1 to SLm, a plurality of (n) scanning lines GL1 to GLn, and a plurality of (m×n) pixel formation portions 110 which are provided corresponding to respective intersections of these m signal lines SL1 to SLm and n scanning lines GL1 to GLn. Hereinafter, when the m signal lines SL1 to SLm are not distinguished, these are simply referred to as a "signal line SL", and when the n scanning lines GL1 to GLn are not distinguished, these are simply referred to as a "scanning line GL". The m×n pixel formation portions 110 are formed in a matrix shape. Each pixel formation portion 110 is configured of: a TFT 111 whose gate terminal as a control terminal is connected to the scanning line GL passing through the corresponding intersection and whose source terminal as a first conduction terminal is connected to the signal line SL passing through the intersection; a pixel electrode 112 connected to a drain terminal of the TFT 111 as a second conduction terminal; a common electrode 113 commonly provided in the m×n pixel formation portions 110; and a liquid crystal layer sandwiched between the pixel electrode 112 and the common electrode 113, and commonly provided in the plurality of pixel formation portions 110. A liquid crystal capacitance Ccl formed by the pixel electrode 112 and the common electrode 113 constitutes a pixel capacitance. It is to be noted that typically, an auxiliary capacitance is provided in parallel with the liquid crystal capacitance Ccl so as to reliably hold a voltage in the pixel capacitance. For this reason, the pixel capacitance is generally made up of the liquid crystal capacitance Ccl and the auxiliary capacitance. However, in the present specification, the pixel capacitance will be described as being configured only of the liquid crystal capacitance Ccl.

As the TFT 111, for example, a TFT using an oxide semiconductor for a channel layer (hereinafter referred to as "oxide TFT") is used. More specifically, the channel layer of the TFT 12 is formed of InGaZnOx mainly composed of indium (In), gallium (Ga), zinc (Zn) and oxygen (O). Hereinafter, a TFT using InGaZnOx for the channel layer will be referred to as an "IGZO-TFT". The IGZO-TFT has a very small off-leak current as compared to a TFT using polycrystalline silicon, amorphous silicon or the like for the channel layer. For this reason, a signal voltage written into the liquid crystal capacitance Ccl is held for a long period. It should be noted that a similar effect is obtained also in the case of using for the channel layer an oxide semiconductor containing at least one of indium, gallium, zinc, copper (Cu), silicon (Si), tin (Sn), aluminum (Al), calcium (Ca), germanium (Ge), and lead (Pb), for example, as an oxide semiconductor other than InGaZnOx. Further, using the oxide TFT as the TFT 111 is one example, and in place of this, the TFT using polycrystalline silicon, amorphous silicon, or the like may be used.

The display control circuit 200 is typically realized by LSI (Large Scale Integration). The display control circuit 200 receives data DAT including image data from the host 1 via the FPC 20, and in accordance with this, the display control circuit 200 generates and outputs a signal line control signal SCT, a scanning line control signal GCT, and a common potential Vcom. The signal line control signal SCT is given to the signal line drive circuit 300. The scanning line control signal GCT is given to the scanning line drive circuit 400. The common potential Vcom is given to the common electrode 113. In the present embodiment, transmission/reception of the data DAT between the host 1 and the display control circuit 200 is performed via an interface conforming to the DSI (Display Serial Interface) standard proposed by the MIPI (Mobile Industry Processor Interface) Alliance. This interface conforming to the DSI standard enables data transmission at high speed. In the present embodiment, a video mode or a command mode of the interface conforming to the DSI standard is used.

The signal line drive circuit 300 generates and outputs a driving image signal to be given to the signal line SL in accordance with the signal line control signal SCT. The signal line control signal SCT, for example, includes a digital image signal corresponding to RGB data RGBD, a source start pulse signal, a source clock signal, a latch strobe signal, and the like. The signal line drive circuit 300 gets a shift register, a sampling latch circuit and the like, which are located inside and not shown, to operate in accordance with the source start pulse signal, the source clock signal, and the latch strobe signal, and converts a digital signal obtained based on the digital image signal to an analog signal in a DA conversion circuit, not shown, thereby generating the driving image signal.

The scanning line drive circuit 400 repeats application of an active scanning signal to the scanning line GL in a predetermined cycle in accordance with the scanning line control signal GCT. The scanning line control signal GCT includes a gate clock signal and a gate start pulse signal, for example. The scanning line drive circuit 400 gets a shift register and the like, located inside and not shown, to operate in accordance with the gate clock signal and the gate start pulse signal, thereby generating a scanning signal.

The backlight unit 30 is provided on the rear surface side of the liquid crystal display panel 10, and irradiates the rear surface of the liquid crystal display panel 10 with backlight. The backlight unit 30 typically includes a plurality of LEDs (Light Emitting Diodes). The backlight unit 30 may be one controlled by the display control circuit 200 or may be one controlled by another method. It is to be noted that, when the liquid crystal display panel 10 is a reflection type, the backlight unit 30 is not required to be provided.

In such a manner as above, the driving image signal is applied to the signal line SL, the scanning signal is applied to the scanning line GL, and the backlight unit 30 is driven, whereby a screen in accordance with the image data transmitted from the host 1 is displayed on the display portion 100 of the liquid crystal display panel 10.

2.2 Configuration of Display Control Circuit

Next, a configuration of the display control circuit 200 will be described in three separate forms. A first form is a form in which the video mode is used and a RAM (Random Access Memory) is not provided. Hereinafter, such a first form will be referred to as "video mode RAM through". The second form is a form in which the video mode is used and the RAM is provided. Hereinafter, such a second form will be referred to as "video mode RAM capture". The third form is a form in which the command mode is used and the RAM is provided. Hereinafter, such a third form will be referred to as "command mode RAM write". It should be noted that, since the present invention is not restricted to the interface conforming to the DSI standard, the configuration of the display control circuit 200 is not restricted to these three kinds of forms.

<2.2.1 Video Mode RAM Through>

Figure 5:
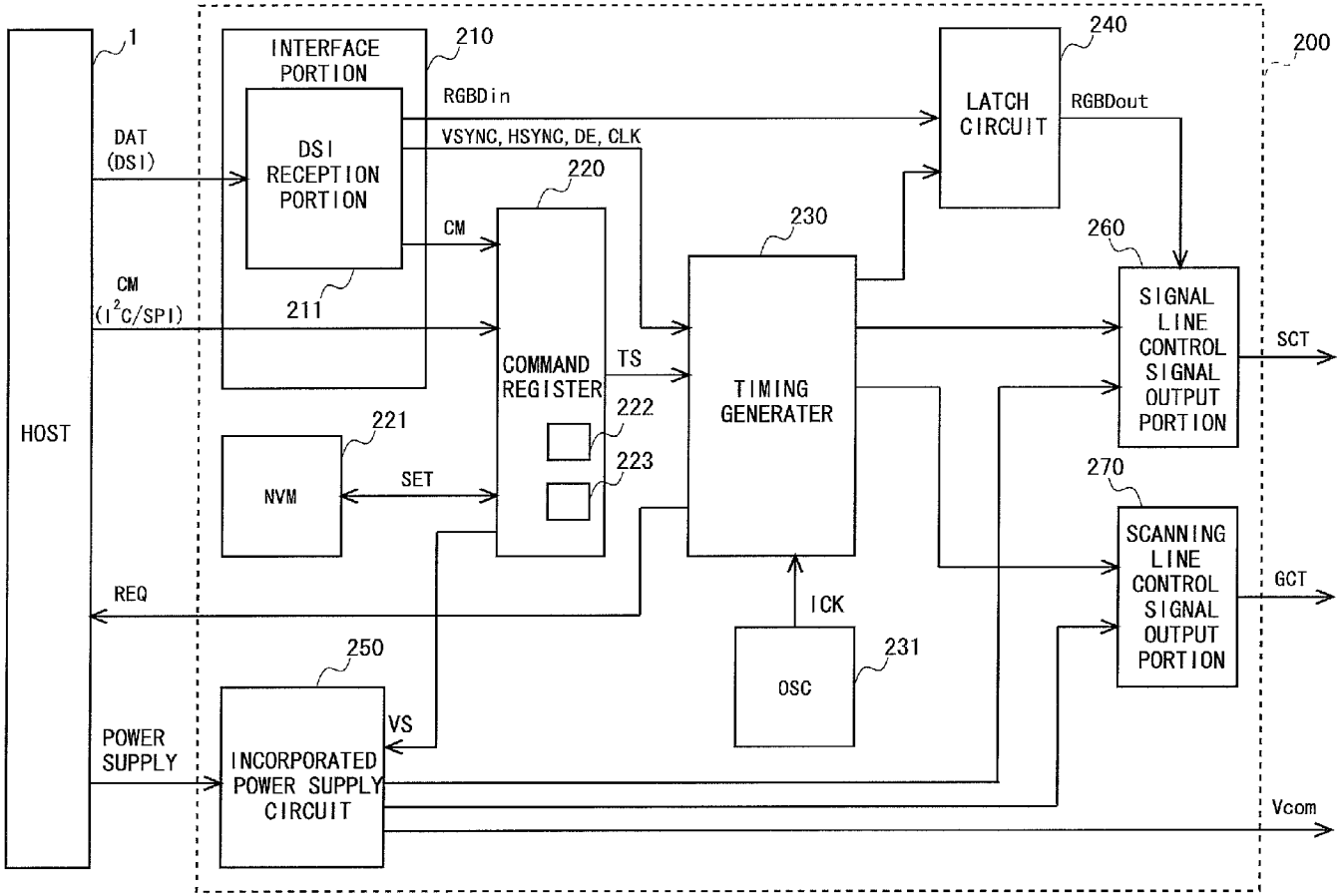
FIG. 5 is a block diagram showing a configuration of a display control circuit corresponding to a video mode RAM through which is included in the liquid crystal display device shown in FIG. 1.

FIG. 5 is a block diagram showing the configuration of the display control circuit 200 corresponding to the video mode RAM through (hereinafter referred to as "display control circuit 200 of the video mode RAM through") included in the liquid crystal display device 2 shown in FIG. 4. As shown in FIG. 5, the display control circuit 200 is provided with an interface portion 210, a command register 220, an NVM (Non-volatile memory) 221, a timing generator 230, an OSC (Oscillator) 231, a latch circuit 240, an incorporated power supply circuit 250, a signal line control signal output portion 260, and a scanning line control signal output portion 270. A DSI reception portion 211 is included in the interface portion 210. In addition, as described above, both or either one of the signal line drive circuit 300 and the scanning line drive circuit 400 may be provided in the display control circuit 200.

The DSI reception portion 211 in the interface portion 210 conforms to the DSI standard. The data DAT in the video mode includes RGB data RGBD as image data; synchronization signals, i.e., a vertical synchronization signal VSYNC, a horizontal synchronization signal HSYNC, a data enable signal DE, a clock signal CLK; and command data CM. The command data CM includes data concerning a variety of control. When receiving the data DAT from the host 1, the DSI reception portion 211 transmits RGB data RGBDin included in the data DAT to the latch circuit 240, transmits the vertical synchronization signal VSYNC, the horizontal synchronization signal HSYNC, the data enable signal DE and the clock signal CLK to the timing generator 230, and transmits the command data CM to the command register 220. It should be noted that the command data CM may be transmitted to the command register 220 from the host 1 via an interface conforming to the I2C (Inter Integrated Circuit) standard or the SPI (Serial Peripheral Interface) standard. In this case, the interface portion 210 includes a reception portion conforming to the I2C standard or the SPI standard.

The command register 220 holds the command data CM. Setting data SET for a variety of control are held in the NVM 221. The command register 220 reads the setting data SET held in the NVM 221. Further, the setting data SET can be updated in accordance with the command data CM transmitted from the host 1. Respective data showing the timing for performing a refresh in the first and second refresh periods are included in the setting data SET, and respectively stored in two registers 222, 223 provided in the command register 220. In the first and second refresh periods, the command register 220 generates a timing control signal TS for refreshing the screen of the display portion 100 based on the data stored in the registers 222, 223, and transmits this to the timing generator 230. Further, it transmits a voltage setting signal VS to the incorporated power supply circuit 250.

The timing generator 230 transmits a control signal for controlling the latch circuit 240, the signal line control signal output portion 260, and the scanning line control signal output portion 270 based on the vertical synchronization signal VSYNC, the horizontal synchronization signal HSYNC, the data enable signal DE, the clock signal CLK, the timing control signal TS, and an incorporated clock signal ICK generated in the OSC 231.

Further, at the time of performing a refresh, in order to request the host 1 to transmit the data DAT, the timing generator 230 transmits to the host 1 a request signal REQ generated based on the vertical synchronization signal VSYNC, the horizontal synchronization signal HSYNC, the data enable signal DE, the clock signal CLK, the timing control signal TS, and the incorporated clock signal ICK generated in the OSC 231. It is to be noted that the OSC 231 is not essential in the display control circuit 200 of the video mode RAM through.

When receiving the request signal REQ, the host 1 transmits the data DAT to the display control circuit 200. As thus described, at the time of performing a refresh in the first and second refresh periods, the required data DAT is transmitted from the host 1 in each time in accordance with the request signal REQ, and the screen is refreshed based on the transmitted data DAT.

Based on control of the timing generator 230, the latch circuit 240 transmits not only the RGB data RGBDout included in the updated data DAT but also RGB data RGBDout included in the data DAT transmitted based on the request signal REQ, for each one line, to the signal line control signal output portion 260. In such a manner, by displaying the same image as the image currently displayed on the display portion 100, the screen can be refreshed at a required timing.

Based on a power supply given from the host 1 and the voltage setting signal VS given from the command register 220, the incorporated power supply circuit 250 generates and outputs a power supply voltage and the common potential Vcom for use in the signal line control signal output portion 260 and the scanning line control signal output portion 270.

The signal line control signal output portion 260 generates the signal line control signal SCT based on the RGB data RGBDout from the latch circuit 240, the control signal from the timing generator 230 and the power supply voltage from the incorporated power supply circuit 250, and transmits this to the signal line drive circuit 300.

The scanning line control signal output portion 270 generates the scanning line control signal GCT based on the control signal from the timing generator 230 and the power supply voltage from the incorporated power supply circuit 250, and transmits this to the scanning line drive circuit 400.

<2.2.2 Video Mode RAM Capture>

Figure 6:
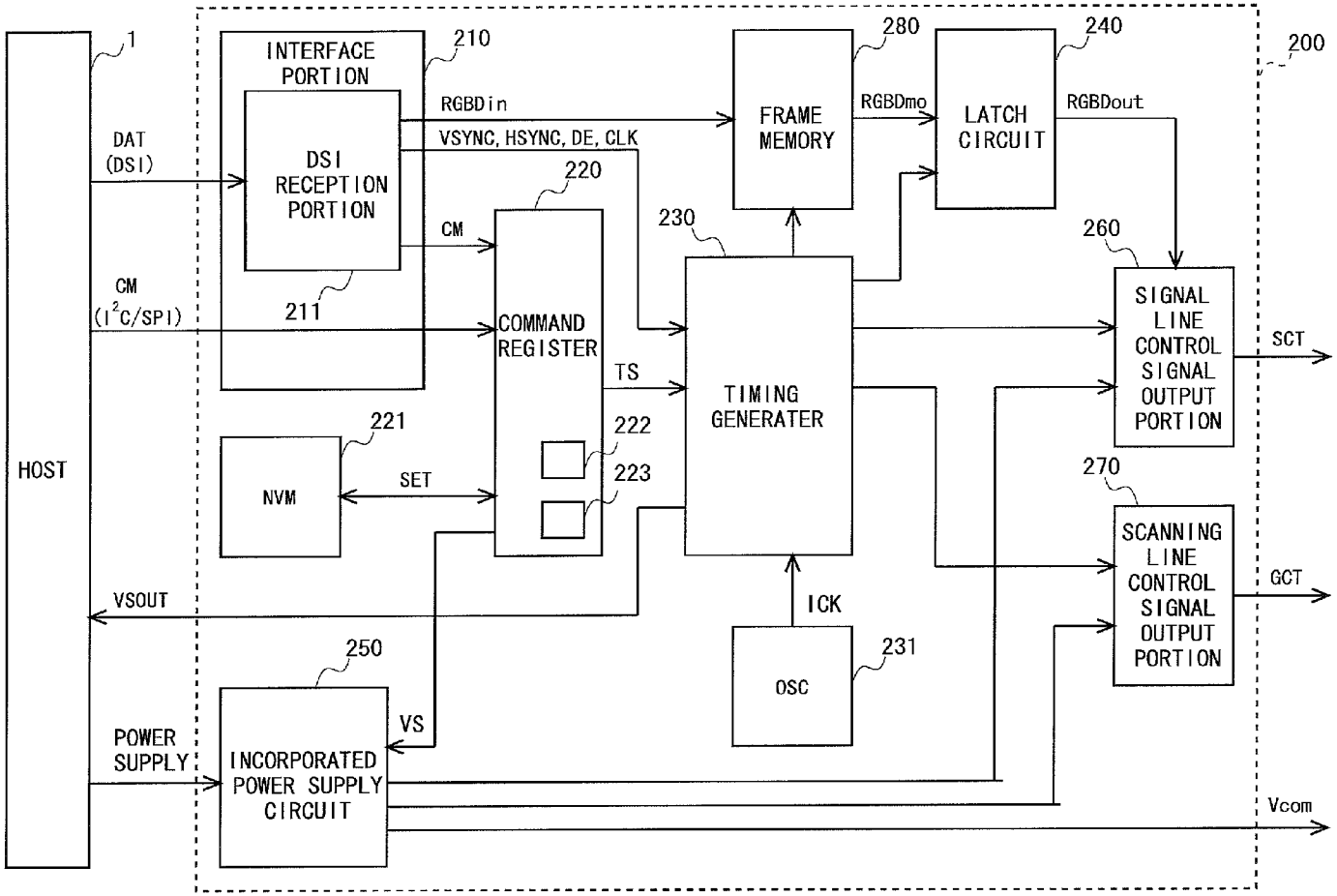
FIG. 6 is a block diagram showing a configuration of a display control circuit corresponding to a video mode RAM capture which is included in the liquid crystal display device shown in FIG. 1.

FIG. 6 is a block diagram showing the configuration of the display control circuit 200 corresponding to the video mode RAM capture (hereinafter referred to as "display control circuit 200 of the video mode RAM capture") included in the liquid crystal display device 2 shown in FIG. 4. The display control circuit 200 of the video mode RAM capture is one obtained by adding a frame memory (RAM) 280 to the foregoing display control circuit 200 of the video mode RAM through, as shown in FIG. 6.

In the display control circuit 200 of the video mode RAM through, the RGB data RGBDin is directly transmitted from the DSI reception portion 211 to the latch circuit 240. However, in the display control circuit 200 of the video mode RAM capture, the RGB data RGBDin transmitted from the DSI reception portion 211 is held in the frame memory 280. Then, RGB data RGBDmo held in the frame memory 280 is read in the latch circuit 240 in accordance with the control signal generated in the timing generator 230. Further, the timing generator 230 transmits a vertical synchronization output signal VSOUT to the host 1. The vertical synchronization output signal VSOUT is a signal for controlling the timing for transmitting the data DAT from the host 1 such that the timing for writing the RGB data RGBDin into the frame memory 280 is not overlapped with the timing for reading the RGB data RGBDmo from the frame memory 280. The other configurations and operations of the display control circuit 200 of the video mode RAM capture are the same as those of the display control circuit 200 of the video mode RAM through, and hence descriptions thereof will be omitted. It is to be noted that the OSC 231 is not essential in the display control circuit 200 of the video mode RAM capture.

Further, when receiving the timing control signal TS for refreshing the screen of the display portion 100 from the command register 220, the timing generator 230 transmits the control signal to the frame memory 280. Thereby, RGB data RGBDmo held in the frame memory 280 is read in the latch circuit 240 in accordance with the control signal received from the timing generator 230.

In the display control circuit 200 of the video mode RAM capture, the RGB data RGBDmo can be held in the frame memory 280. For this reason, in the case of refreshing the screen, the data DAT is not required to be transmitted from the host 1 to the display control circuit 200, but in accordance with the timing for performing a refresh, the timing generator 230 transmits the control signal to the frame memory 280. In such a manner, by displaying the same image as the image currently displayed on the display portion 100, the screen can be refreshed at a required timing.

<2.2.3 Command Mode RAM Write>

Figure 7:
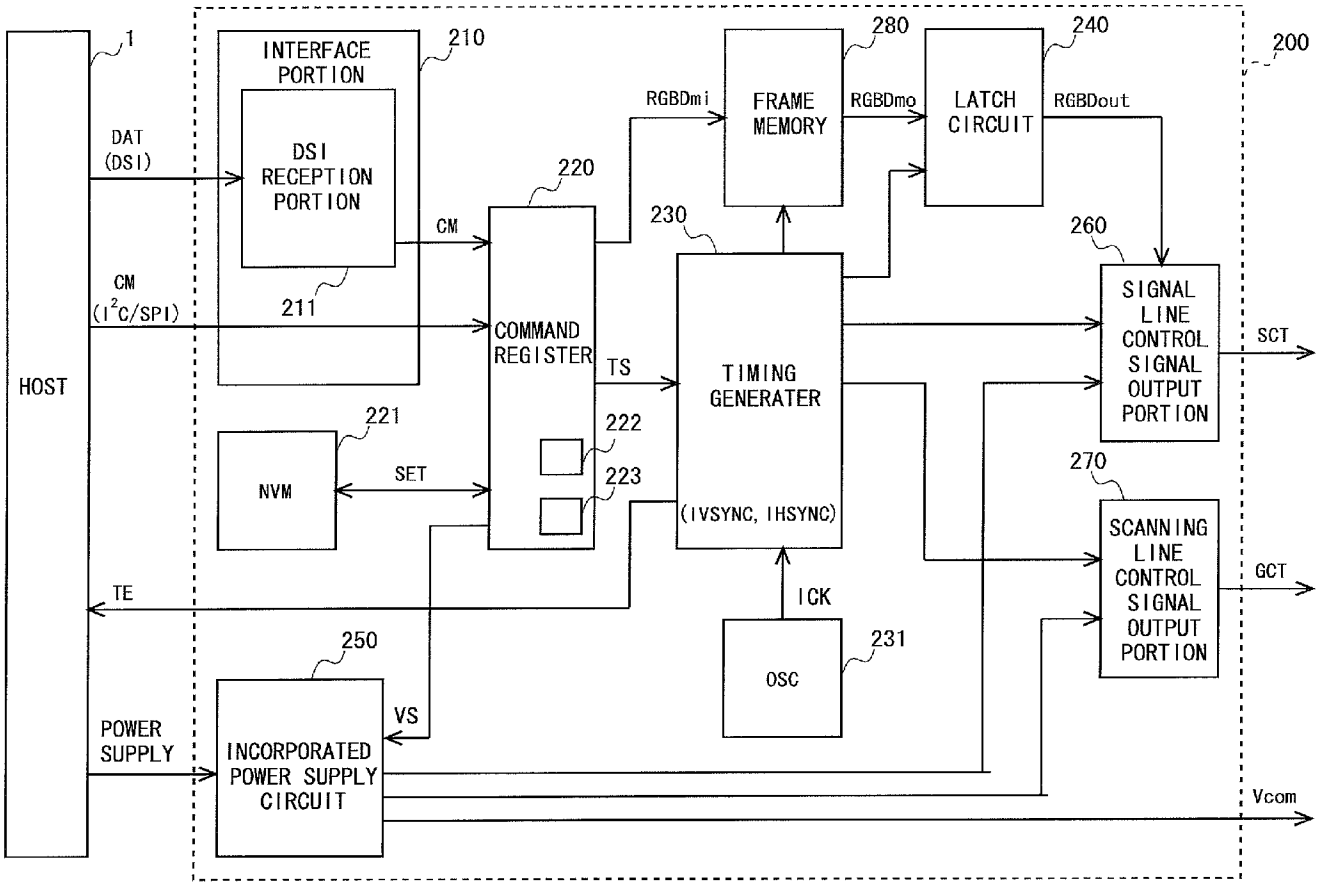
FIG. 7 is a block diagram showing a configuration of a display control circuit corresponding to a command mode RAM write which is included in the liquid crystal display device shown in FIG. 1.

FIG. 7 is a block diagram showing the configuration of the display control circuit 200 corresponding to the command mode RAM write (hereinafter referred to as "display control circuit 200 of the command mode RAM write") included in the liquid crystal display device 2 shown in FIG. 4. As shown in FIG. 7, the display control circuit 200 of the command mode RAM write has a similar configuration to that of the foregoing display control circuit 200 of the video mode RAM capture, but the kind of data included in the data DAT is different.

The data DAT in the command mode includes the command data CM, and does not include the RGB data RGBDin, the vertical synchronization signal VSYNC, the horizontal synchronization signal HSYNC, the data enable signal DE and the clock signal CLK. However, the command data CM in the command mode includes data concerning the image and data concerning a variety of timing. Out of the command data CM, the command register 220 transmits a RAM write signal RGBDmi that corresponds to the data concerning the image to the frame memory 280. This RAM write signal RGBDmi corresponds to the above RGB data RGBDin. Further, in the command mode, the timing generator 230 does not receive the vertical synchronization signal VSYNC and the horizontal synchronization signal HSYNC, and thus generates on its inside an internal vertical synchronization signal IVSYNC and an internal horizontal synchronization signal IHSYNC corresponding to the incorporated clock signal ICK and the timing control signal TS based on those signals. Based on these internal vertical synchronization signal IVSYNC and internal horizontal synchronization signal IHSYNC, the timing generator 230 controls the latch circuit 240, the signal line control signal output portion 260 and the scanning line control signal output portion 270. Further, the timing generator 230 transmits to the host 1 a transmission control signal TE corresponding to the above vertical synchronization output signal VSOUT.

In addition, the operations of the command register 220, the timing generator 230, and the frame memory 280 at the time of refreshing the image are the same as the operations in the display control circuit 200 of the video mode RAM capture, and hence descriptions thereof will be omitted.

2.3 Summary of Operation

In the present specification, the pause drive means drive in which, when updated image data (RGB data RGBD) is given from the host 1, a frame for making a refresh of the screen pause (hereinafter referred to as "non-refresh frame") is provided after a frame for refreshing the screen (hereinafter referred to as "refresh frame"), and a predetermined number of each of these refresh frames and non-refresh frames are alternately repeated. It should be noted that in the present specification, a description will be given regarding the target refresh rate to be reached at the pause drive time as about 1 Hz, but this is not restrictive, and for example, it may be 0.5 Hz, 2 Hz, or the like. In addition, the RGB data RGBDin and the RGB data RGBDmi shown in FIGS. 5 to 7 may together be described as the RGB data RGBD.

In the refresh frame, the screen is refreshed as described above. More specifically, the driving image signal is supplied from the signal line drive circuit 300 to the signal lines SL1 to SLm in accordance with the signal line control signal SCT that includes the digital image signal corresponding to the RGB data RGBD, and the scanning lines GL1 to GLn are sequentially selected by the scanning line drive circuit 400 in accordance with the scanning line control signal GCT. The TFT 111 corresponding to the selected scanning line GL comes into an on-state, and a voltage of the driving image signal is written into the liquid crystal capacitance Ccl. In such a manner, the image is refreshed. Subsequently, the TFT 111 comes into an off-state, and the voltage written into the liquid crystal capacitance Ccl is held until the screen is next refreshed.

In the non-refresh frame, the foregoing refresh of the screen pauses. More specifically, the supply of the scanning line control signal GCT to the scanning line drive circuit 400 is halted or the scanning line control signal GCT becomes a fixed potential, whereby the operation of the scanning line drive circuit 400 is halted, and hence scanning of the scanning lines GL1 to GLn is not performed. As a result, the driving image signal is not written into the liquid crystal capacitance Ccl in the non-refresh frame. However, since the driving image signal having been written immediately before is held in the liquid crystal capacitance Ccl, the screen refreshed in the refresh frame immediately before continues to be displayed. Further, in the non-refresh frame, the operation of the signal line drive circuit 300 is halted by halting the supply of the signal line control signal SCT to the signal line drive circuit 300, or the like. As thus described, in the non-refresh frame, the operations of the scanning line drive circuit 400 and the signal line drive circuit 300 are halted, thereby allowing reduction in power consumption. It is to be noted that the signal line drive circuit 300 may be operated.

In order to make an afterimage, which is caused by anisotropy of a liquid crystal dielectric constant, visually unrecognizable at the pause drive time, when the updated RGB data RGBD is transmitted from the host 1 to the liquid crystal display device 2, a refresh of writing the voltage of the driving image signal corresponding to the same RGB data RGBD into the liquid crystal capacitance Ccl is performed three times. This allows the liquid crystal molecules to be oriented in the direction corresponding to the applied voltage. It is to be noted that in the present specification, a description will be given assuming that, when the updated RGB data RGBD is transmitted from the host 1, the liquid crystal display device 2 performs a refresh three times, but it may perform a refresh twice or four times or more.

A description will be given of an example of the configuration of the frames at the refresh rate illustrated in the present specification. When the refresh rate is 60 Hz, the refresh frame is repeated and the non-refresh frame is not provided. When the refresh rate is 30 Hz, one non-refresh frame is provided immediately after one refresh frame. When the refresh rate is 20 Hz, two non-refresh frames are provided immediately after one refresh frame. When the refresh rate is 1 Hz, 59 non-refresh frames are provided immediately after one refresh frame. As thus described, the lower the refresh rate, the larger the proportion of the non-refresh frame becomes and the longer the non-refresh period becomes accordingly, thereby allowing more reduction in power consumption.

It is to be noted that the numbers of refresh frames and non-refresh frames in the first refresh period are stored in the register 222 provided in the command register 220. The numbers of refresh frames and non-refresh frames in the second refresh period are stored in the register 223. Then, at the time of generating the timing control signal TS for refreshing the screen of the display portion 100 in the first refresh period, the command register 220 transmits to the timing generator 230 the timing control signal TS generated by use of data read from the register 222 that stores the numbers of refresh frames and non-refresh frames in the first refresh period. At the time of generating the timing control signal TS for refreshing the screen of the display portion 100 in the second refresh period, the command register 220 transmits to the timing generator 230 the timing control signal TS generated by use of data read from the register 223 that stores the numbers of refresh frames and non-refresh frames in the second refresh period.

2.4 Operation of Present Embodiment

Figure 8:
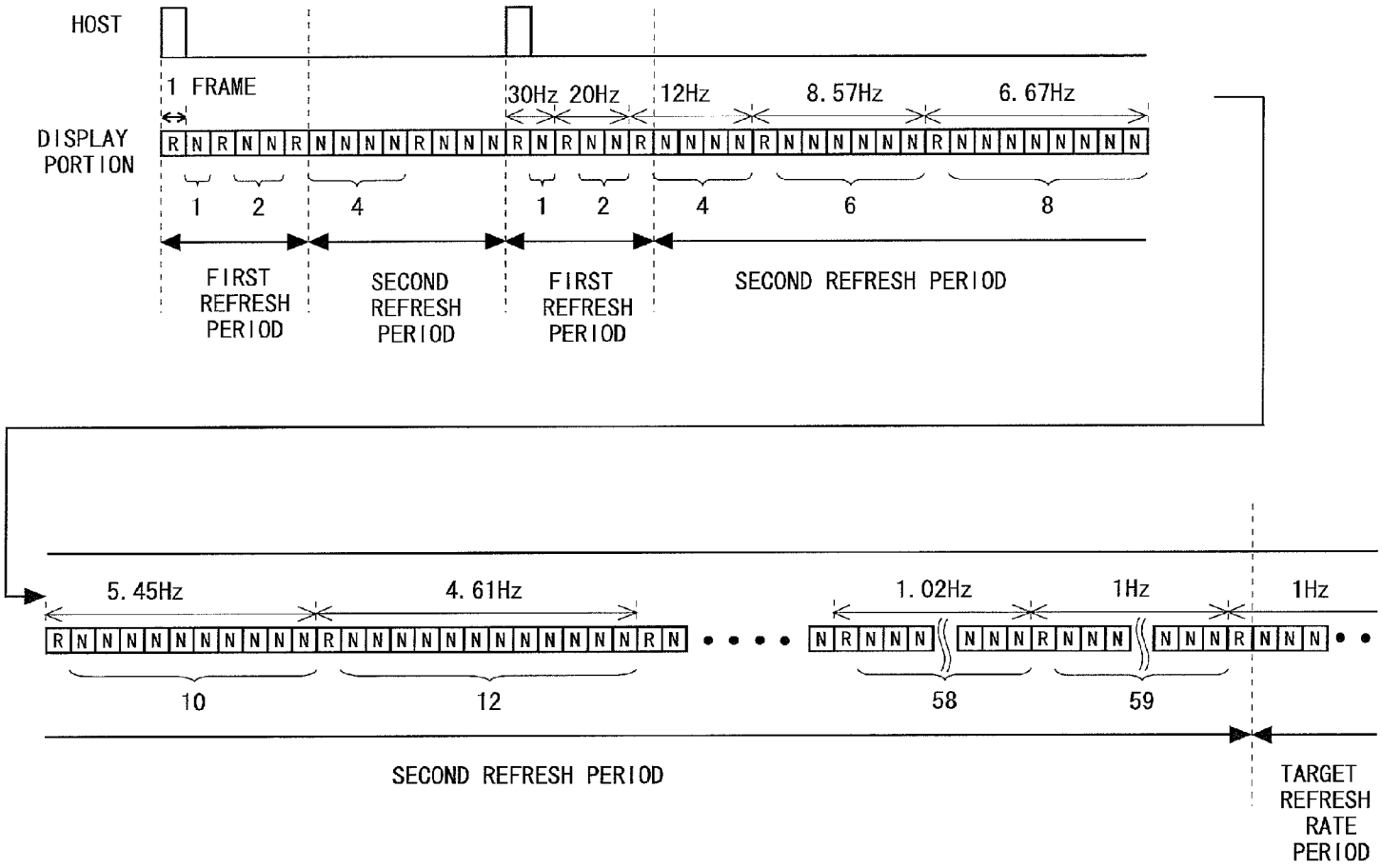
FIG. 8 is a diagram for explaining one example of an operation of a liquid crystal display device according to a first embodiment.

FIG. 8 is a diagram explaining an operation of the liquid crystal display device 2 according to the present embodiment. The liquid crystal display device 2 is a display device provided with an auto-refresh function. Therefore, as shown in FIG. 8, even at the time of performing a refresh in the second refresh period by repeating a refresh and a non-refresh, when newly updated image data is transmitted from the host 1, the refresh having been performed up to now is stopped and a refresh is performed again from the first refresh period. Further, in the present embodiment, it is assumed that the updated image data is irregularly transmitted from the host 1.

In the present embodiment, the frame refreshed by use of newly updated image data is taken as the first frame, and the first refresh period starts from the time when the newly updated image data is transmitted. In the first refresh period, first, the first refresh is performed in the first frame, and a refresh pauses only for one frame in the second frame. Next, the second refresh is performed in the third frame by use of the same image data as the image data used in the first refresh, and a refresh is paused in the fourth and fifth frames. Then, the third refresh is performed in the sixth frame by use of the same image data as the image data used in the first refresh. By a total of three refreshes up to here, the liquid crystal molecules are oriented in the direction corresponding to the applied voltage, and hence an afterimage is not visually recognized in the pause drive thereafter. It should be noted that by providing at least one non-refresh frame between a refresh and a refresh in the first refresh period, it is possible to realize effective pause drive in accordance with each of image data inputted from the outside with a variety of frequencies.

When the third refresh is finished, a shift is then made to the second refresh period. A refresh pauses in four frames from the seventh frame to the tenth frame. Next, the fourth refresh is performed in the eleventh frame, a refresh pauses in six frames from the twelfth frame to the seventeenth frame, and a refresh is performed in the eighteenth frame. Hereinafter, in a similar manner, the number of non-refresh frames is sequentially increased by two until the number of non-refresh frames becomes 58. As a result, the number of refresh frames becomes one, the number of non-refresh frames becomes 58, and the refresh rate in this case is 1.02 Hz. This refresh rate is close to 1 Hz as the target refresh rate for the pause drive, but has yet to become 1 Hz. Then, in order to make the refresh rate become 1 Hz, the number of refresh frames is set to one and the number of non-refresh frames is set to 59. Thereby, the refresh rate becomes 1 Hz, and further, when a refresh immediately thereafter is finished, the second refresh period is finished. Subsequently, the image displayed on the display portion 100 is refreshed at 1 Hz by repeating a refresh at 1 Hz until updated image data is transmitted from the host 1. In this case, the time from the performance of the first refresh in the first frame until the reach to 1 Hz as the target refresh rate for the pause drive is about 14 seconds, and it has been possible to significantly reduce the time as compared to about 28 seconds which is the time required in the second basic consideration. It should be noted that, since the change in display luminance increases due to reduction in time, the display quality slightly deteriorates, but it is not such deterioration as to affect viewing.

2.5 Effect

According to the present embodiment, the refresh rate at the refresh time in the second refresh period is made higher than the refresh rate at the refresh time in the first refresh period. Hence it is possible to finish in a short time the first refresh period for performing three times of refreshes required for making an afterimage, which is visually recognized at the refresh time, visually unrecognizable, and reach 1 Hz as the target refresh rate for the pause drive more quickly in the second refresh period while the refresh rate is lowered in stages. As a result, the liquid crystal display device 2 can make an afterimage visually unrecognizable in the first refresh period. Further, it is possible to reach 1 Hz as the target refresh rate for the pause drive in a short time, so as to reduce the power consumption during and after the shift to the target refresh rate.

Moreover, when data including image data that corresponds to the screen of the display portion 100 is received from the host 1 during the second refresh period, the second refresh period is switched to the first refresh period, and a refresh is performed again from the first refresh period. Thereby, when the image data is updated, the screen of the display portion 100 is immediately refreshed, and the updated image can be displayed on the display portion 100.

2.6 Modified Example

Figure 9:
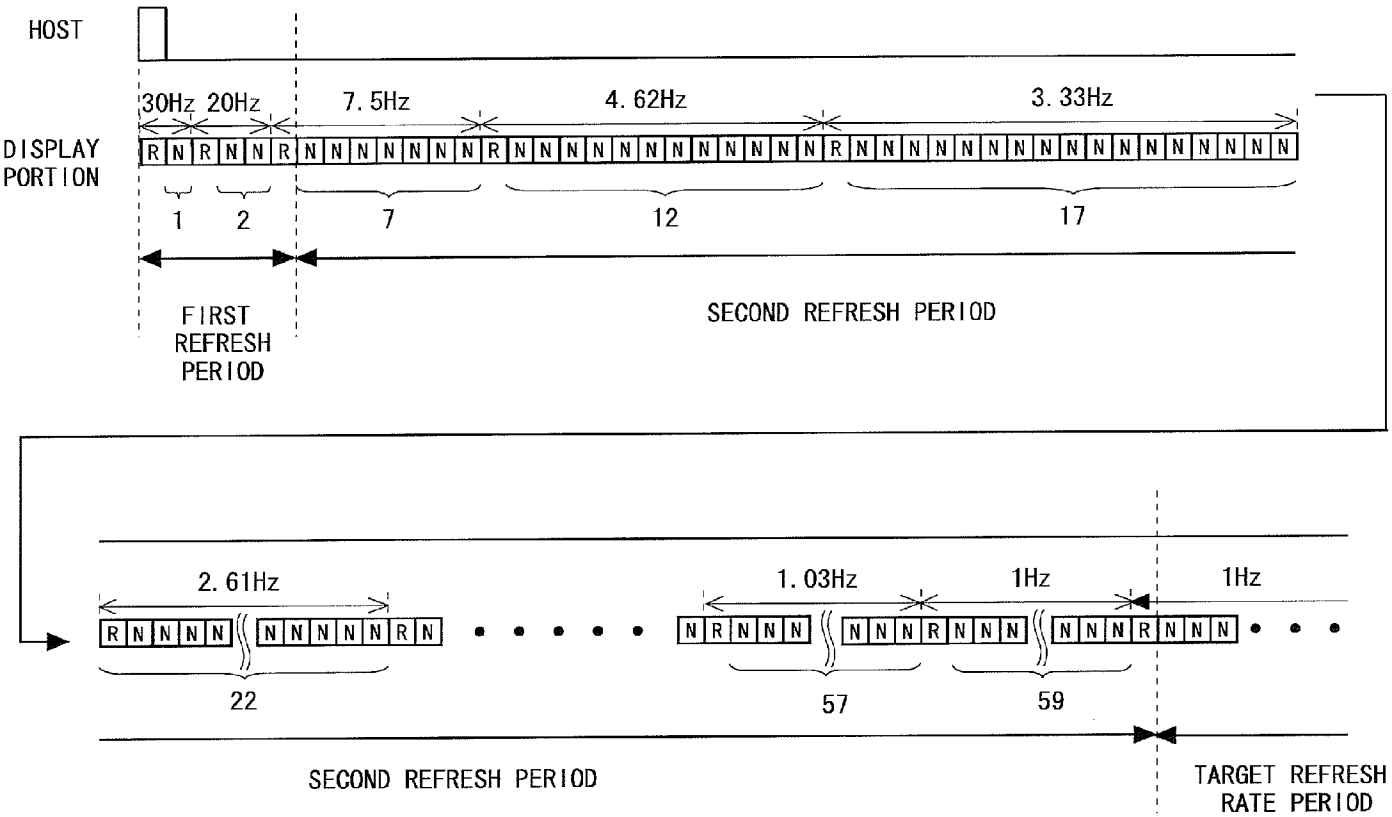
FIG. 9 is a diagram for explaining one example of the operation of the liquid crystal display device according to the modified example of the first embodiment.

In the above embodiment, the number of non-refresh frames in the non-refresh period is increased by two frames in arithmetic progression until the refresh rate in the second refresh period reaches about 1 Hz as the target refresh rate for the pause drive. However, the number of frames increased in stages is not restricted to two, but for example as shown in FIG. 9, the number of frames in the non-refresh period may be increased by five in arithmetic progression. In this case, the number of non-refresh frames is sequentially increased by five until the number of non-refresh frames becomes 57. As a result, the number of refresh frames becomes one, the number of non-refresh frames becomes 57, and the refresh rate in this case is 1.03 Hz. This refresh rate is close to 1 Hz as the target refresh rate for the pause drive, but has yet to become 1 Hz. Then, in order to make the refresh rate become 1 Hz, the number of refresh frames is set to one and the number of non-refresh frames is set to 59. Thereby, the refresh rate becomes 1 Hz, and further, when a refresh immediately thereafter is finished, the second refresh period is finished. As a result, the time from the performance of the first refresh in the first frame until the refresh rate reaches 1 Hz as the target refresh rate is about seven seconds, and is thus further reduced. Hence it is possible to further reduce the power consumption of the liquid crystal display device 2 until the refresh rate reaches the target refresh rate.

Figure 10:
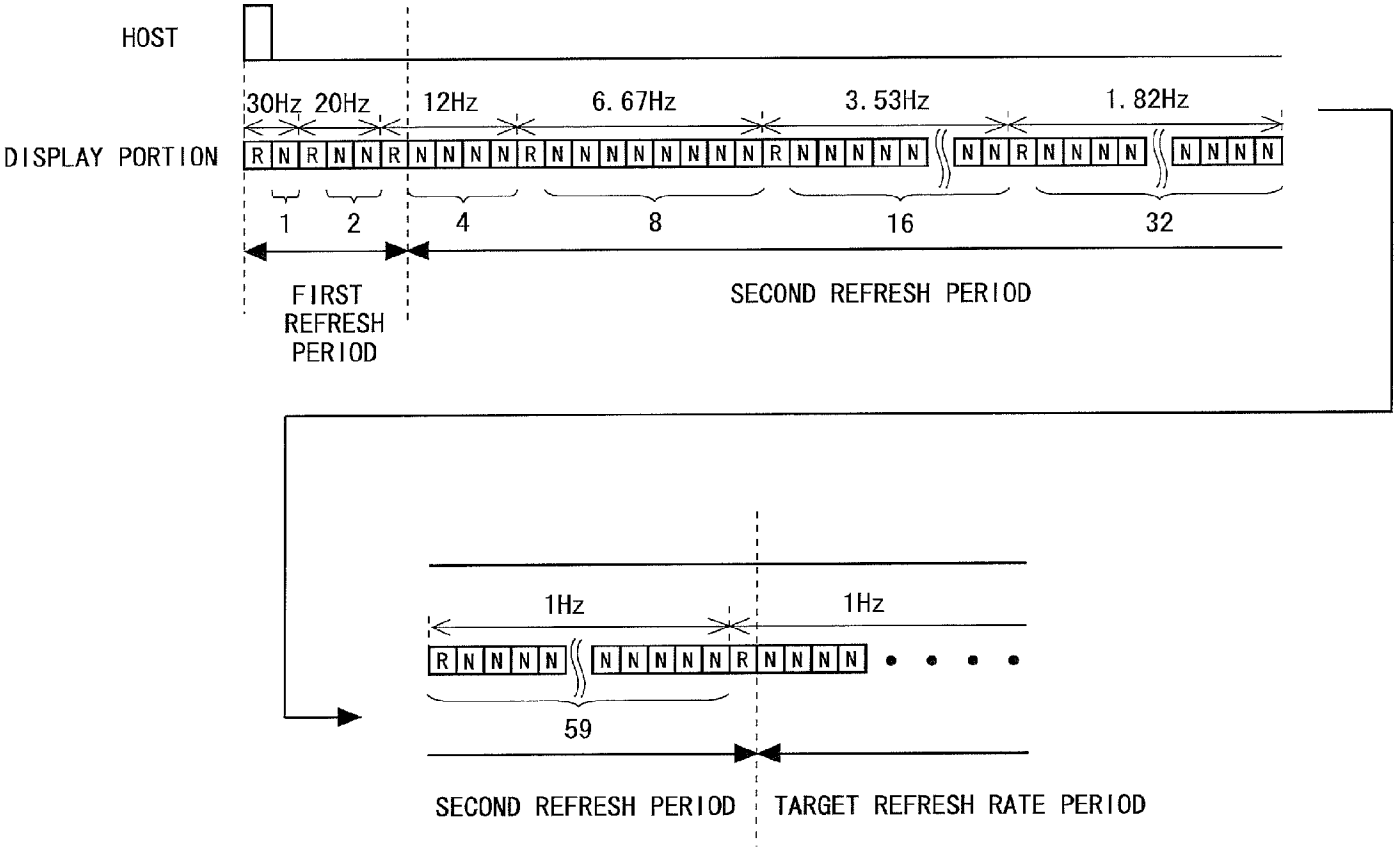
FIG. 10 is a diagram for explaining one example of an operation of a liquid crystal display device according to a modified example of the first embodiment of the present invention.

Further, the number of non-refresh frames until the refresh rate in the second refresh period reaches to 1 Hz may be increased in geometric progression. For example, as shown in FIG. 10, the number of frames in the non-refresh period may be sequentially increased like $2^1$, $2^2$, $2^3$ . . . . In this case, the number of non-refresh frames is sequentially increased by power of two until the number of non-refresh frames becomes 32. When the number of refresh frames is set to one and the number of non-refresh frames is set to $2^4$, namely 32, the refresh rate becomes 1.82 Hz, which is still higher than the target refresh rate for the pause drive. Further, when the number of non-refresh frames is set to $2^5$, namely 64, the refresh rate becomes 0.92 Hz, which is conversely lower than the target refresh rate. Then, in order to make a refresh rate, which is subsequent to 1.82 Hz, become the target refresh rate, the number of refresh frames is set to one and the number of non-refresh frames is set to 59. Accordingly, the refresh rate becomes 1 Hz as the target refresh rate. Further, when a refresh immediately thereafter is finished, the second refresh period is finished. As a result, the time from the performance of the first refresh in the first frame until the refresh rate reaches 1 Hz as the target refresh rate is about two seconds, and is thus even more reduced. Hence it is possible to further reduce the power consumption of the liquid crystal display device 2 until the refresh rate reaches the target refresh rate for the pause drive.

The number of non-refresh frames, which is increased in stages in the non-refresh period in order to lower the refresh rate in stages, is not restricted to the above numeral value, but can be appropriately set. Further, the set value is held in the registers 222, 223 provided in the command register 220 of the display control circuit 200, and used at the time of generating the timing control signal TS.

It should be noted that, when the second refresh period is made excessively long, the time until the reach to 1 Hz as the target refresh rate becomes long, thereby leading to an increase in power consumption of the liquid crystal display device 2 until the refresh rate becomes the target refresh rate. On the other hand, when the second refresh period is excessively reduced, the change in display luminance becomes large, thereby leading to deterioration in display quality. Therefore, in order to achieve both reduction in power consumption and prevention of deterioration in display quality, the refresh rate in the second refresh period is required to be appropriately adjusted.

Further, in the above embodiment, the number of non-refresh frames between the first refresh and the second refresh and the number of non-refresh frames between the second refresh and the third refresh in the first refresh period have been respectively set to 1 and 2. However, the number of non-refresh frames in the first refresh period is not restricted thereto, and for example, they may be set to different values such as 1 and 3, or may be set to the same value such as 1 and 1. It should be noted that in the present specification, when the number of non-refresh frames between the first refresh and the second refresh and the number of non-refresh frames between the second refresh and the third refresh are, for example, set to one, each fresh rate becomes 30 Hz. It is assumed that the change in refresh rate in this case is "zero". Further, since it is preferable that an afterimage which is visually recognized at the refresh time be promptly made visually unrecognizable, it is preferable to reduce the first refresh period. However, by providing at least one or more non-refresh frames between each refresh frame, image data at a variety of refresh rates can be received from the outside.

3. Second Embodiment

Figure 11:
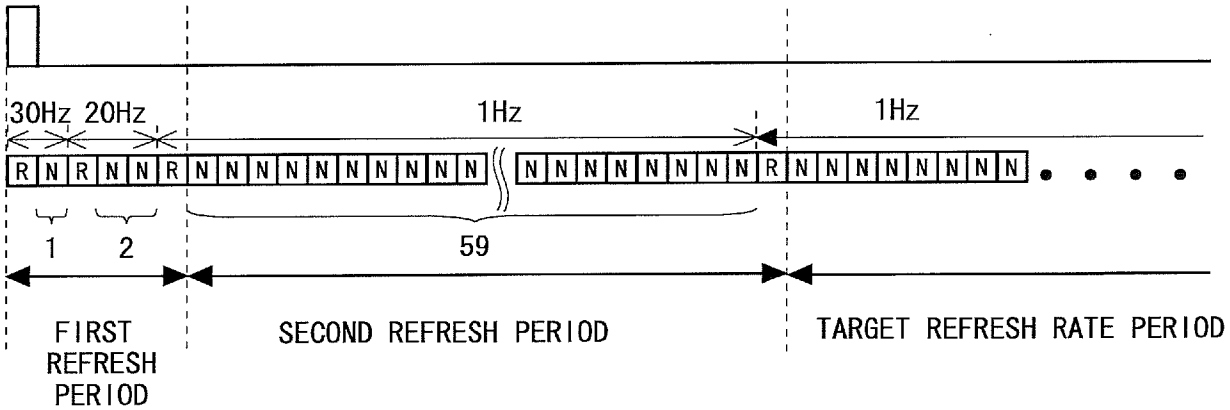
FIG. 11 is a diagram for explaining one example of an operation of a liquid crystal display device according to a second embodiment of the present invention.

FIG. 11 is a diagram for explaining an operation of the liquid crystal display device 2 according to a second embodiment of the present invention. It is to be noted that, since the present embodiment is similar to the above first embodiment except for the operation, there will be omitted a block diagram showing the configuration of the liquid crystal display device 2 and the configuration of the display control circuit 200 included in the liquid crystal display device 2, and descriptions thereof.

3.1 Operation

In the above first embodiment, the first refresh period for making an afterimage visually unrecognizable at the refresh time and the second refresh period for changing the display luminance in stages have been provided. In the present embodiment, as shown in FIG. 11, the first refresh period is the same as in the case of the first embodiment, but the second refresh period is very short.

Specifically, in the first refresh period, first, the first refresh is performed in the first frame, and a refresh pauses in the second frame. Next, the second refresh is performed in the third frame by use of the same image data as in the first refresh, and a refresh pauses in the fourth and fifth frames. Then, the third refresh is performed in the sixth frame by use of the same image data as in the first refresh. When the third refresh is finished, a shift is made to the second refresh period.

In the second refresh period, the refresh rate is not changed in stages, but after the end of the third refresh, a refresh pauses in 59 frames from the seventh frame to the sixty-fifth frame, and a refresh is performed in the sixty-sixth frame. Thereby, the refresh rate in the second refresh period gets straight to the same refresh rate as 1 Hz that is the target refresh rate for the pause drive. Thereafter, updating of the image displayed on the display portion 100 at the refresh rate of 1 Hz is repeated until newly updated image data is transmitted from the host 1. It should be noted that the number of non-refresh frames in the first refresh period is not restricted to the above described case as in the case of the first embodiment.

3.2 Effect

According to the present embodiment, in the first refresh period, a refresh is performed three times by use of updated image data transmitted from the host 1. Hence it is possible to make an afterimage, which is caused by anisotropy of a liquid crystal dielectric constant, visually unrecognizable at refresh time thereafter. Further, in the second refresh period, the refresh rate is set straight to 1 Hz without being changed in stages, and hence it can reach 1 Hz as the target refresh rate for the pause drive in the shortest time. In this case, the time from the start of the first refresh in the first frame until the reach to about 1 Hz as the target refresh rate is one second, which is significantly reduced. Hence it is possible to significantly reduce the power consumption of the liquid crystal display device 2 until the target refresh rate is reached.

4. Third Embodiment

Figure 12:
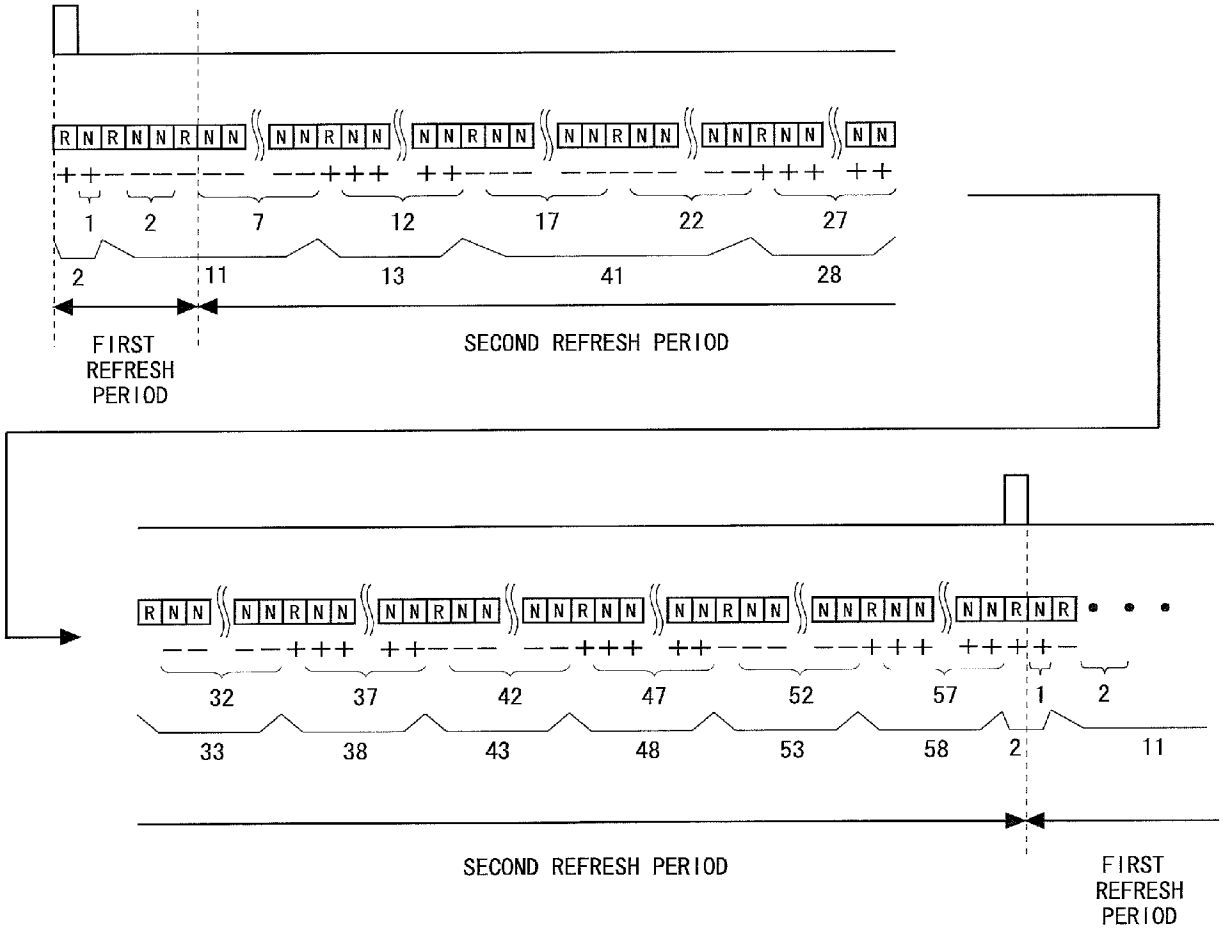
FIG. 12 is a signal waveform diagram for explaining optimal polarity control that is set in a third embodiment of the present invention.

FIG. 12 is a diagram for explaining an operation of the liquid crystal display device 2 according to a third embodiment of the present invention. It is to be noted that, since the present embodiment is similar to the above first embodiment except for the operation, there will be omitted a block diagram showing the configuration of the liquid crystal display device 2 and the configuration of the display control circuit 200 included in the liquid crystal display device 2, and descriptions thereof.

4.1 Operation

Throughout the first and second refresh periods, when a balance between positive polarity and negative polarity of the applied voltage of the liquid crystal capacitance Ccl is not considered, the time when a voltage in a specific direction is applied to the liquid crystal layer becomes long, causing the deterioration in liquid crystal layer to tend to gets worse. Accordingly, in the present embodiment, the deterioration in liquid crystal layer is suppressed while an afterimage at the refresh time is made visually unrecognizable and the display luminance is changed in stages.

In the present embodiment, polarity reversal drive (i.e., Alternating Current (AC) drive) is performed in order to suppress the deterioration in liquid crystal layer. Under each refresh frame and non-refresh frame shown in FIG. 12, there is shown polarity of a voltage that is applied at the refresh time performed in the frame. Specifically, "+" indicates that the polarity of the voltage applied to the pixel electrode 112 is the positive polarity and the polarity of the voltage applied to the common electrode 113 is the negative polarity. "−" indicates that the polarity of the voltage applied to the pixel electrode 112 is the negative polarity and the polarity of the voltage applied to the common electrode 113 is the positive polarity. Hereinafter, a refresh frame for performing a refresh at a positive polarity voltage will be referred to as a "positive polarity refresh frame", and a refresh frame for performing a refresh at a negative polarity voltage will be referred to as a "negative polarity refresh frame".

As shown in FIG. 12, in the first refresh period, the number of non-refresh frames is increased by one in every non-refresh period. Further, in the second refresh period, the number of non-refresh frames is increased by five in every non-refresh period until the refresh rate reaches 1.02 Hz as the target refresh rate for the pause drive.

In this case, in the first refresh period, the first refresh performed in the first frame is a positive polarity refresh, and hence a positive polarity non-refresh is performed also in the second frame subsequent thereto. Next, the second refresh performed in the third frame is a negative polarity refresh, and hence a negative polarity non-refresh is performed also in the fourth and fifth frames subsequent thereto. The third refresh performed in the sixth frame is a negative polarity refresh, and hence a negative polarity non-refresh is performed also in seven frames from the seventh frame to the thirteenth frame subsequent thereto. The fourth refresh performed in the fourteenth frame is a positive polarity refresh, and hence a positive polarity non-refresh is performed also in twelve frames from the fifteenth frame to the twenty-sixth frame subsequent thereto. Hereinafter, in a similar manner, there is made a repetition of performing a positive polarity or negative polarity refresh in every refresh, and the thirteenth refresh is performed and a non-refresh is performed in 57 frames subsequent thereto. Both the refresh and the non-refresh is a positive polarity one, and the refresh rate is 1.03 Hz. As a result, the number of positive polarity frames (positive polarity refresh frames and non-refresh frames subsequent thereto) from the first refresh and the non-refresh subsequent thereto to the thirteenth refresh and the non-refresh subsequent thereto is 187. On the other hand, the number of negative polarity frames (negative polarity refresh frames and non-refresh frames subsequent thereto) from the second refresh and the non-refresh subsequent thereto to the twelfth refresh and the non-refresh subsequent thereto is 181. As thus described, a refresh is performed such that the number of positive polarity frames and the number of negative polarity frames are approximately in the same proportion. It is to be noted that, since updated image data is transmitted from the host 1 immediately after the thirteenth refresh is performed and the non-refresh is performed in 57 frames subsequent thereto, when a refresh by use of the updated image data is finished, the second refresh period is finished, and shifted to the first refresh period.

Further, the arrangement in which the number of positive polarity frames and the number of negative polarity frames are in approximately the same proportion, shown in FIG. 12, is one example and this is not restrictive. However, it is preferable to avoid, as much as possible, consecutive refreshes with the same polarity. Further, the smaller the difference in proportion between the number of positive polarity frames and the number of negative polarity frames, the more preferable it is, and there is most preferred a case where the number of positive polarity frames and the number of negative polarity frames are in the same proportion.

Further, a decrease in applied voltage of the liquid crystal capacitance Ccl caused by a leak current of the TFT 111 varies depending on the length of the pause period, namely the refresh rate, and the lower the refresh rate, the more the applied voltage decreases. Therefore, in order to reduce the irregularity of the applied voltage of the liquid crystal capacitance Ccl due to different refresh rates, data of the optimal common potential Vcom is previously put into, for example, the NVM 221, for each refresh rate as one of the setting data SET. When the command register 220 generates the voltage setting signal VS corresponding to the optimal common potential Vcom in accordance with the refresh rate and transmits it to the incorporated power supply circuit 250, the incorporated power supply circuit 250 outputs the optimal common potential Vcom. This allows application of the optimal common potential Vcom to the common electrode 113 for each refresh rate. In this case, data of the optimal common potential Vcom may be given as part of the command data CM from the host 1 to the command register 220.

4.2 Effect

According to the present embodiment, a similar effect to that in the case of the first embodiment is achieved and further, throughout the first and second refresh periods, the positive polarity period made up of a refresh period for performing a refresh with positive polarity and a non-refresh period immediately after the refresh period and the negative polarity period made up of a refresh period for performing a refresh with negative polarity and a non-refresh period immediately after the refresh period are set to be in approximately the same proportion, whereby the time when a voltage in a specific direction is applied to the liquid crystal layer does not become long. In such a manner, by performing Alternating Current (AC) drive on the liquid crystal layer so as to get a favorable polarity balance, it is possible to suppress the deterioration in liquid crystal layer.

5. Fourth Embodiment

Figure 13:
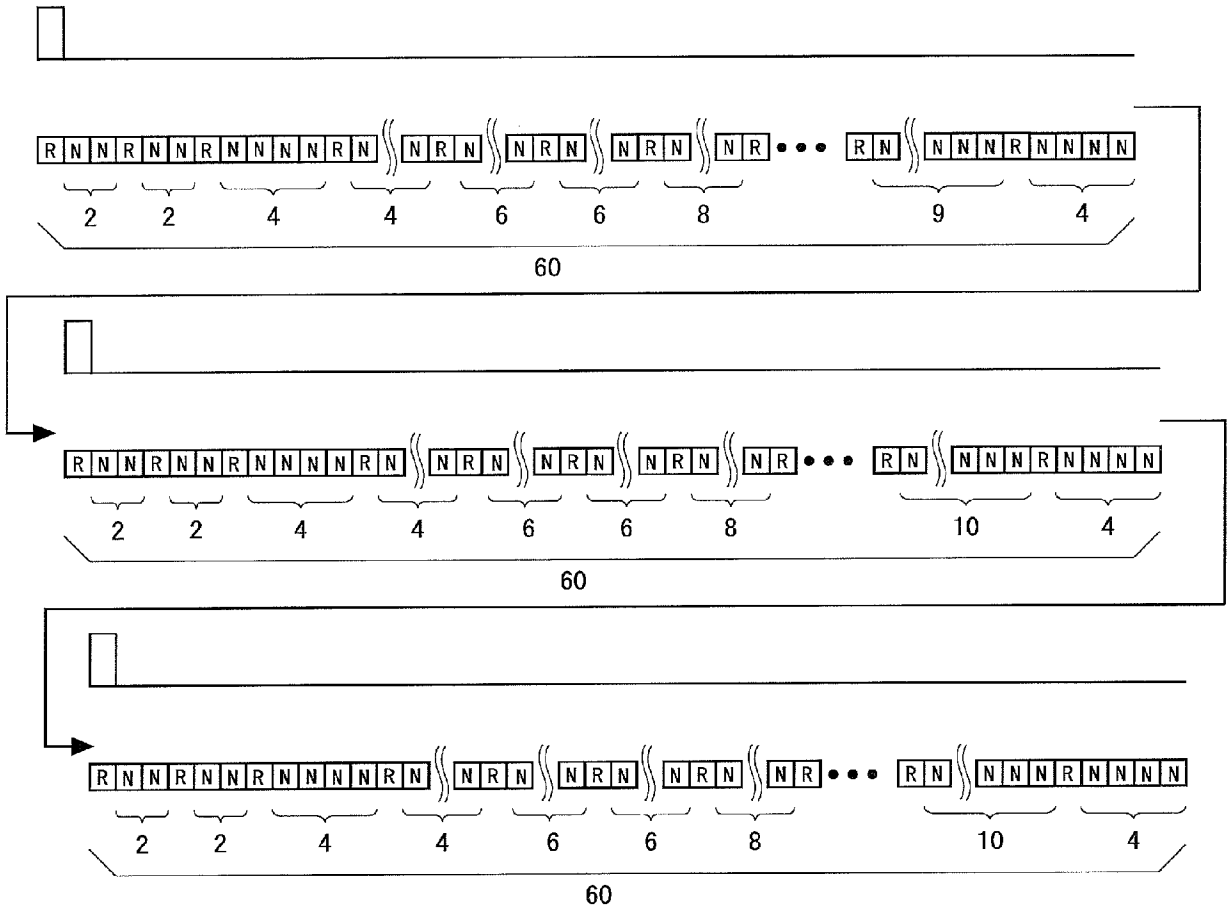
FIG. 13 is a diagram for explaining one example of an operation of a liquid crystal display device according to the fourth embodiment of the present invention.
Figure 14:
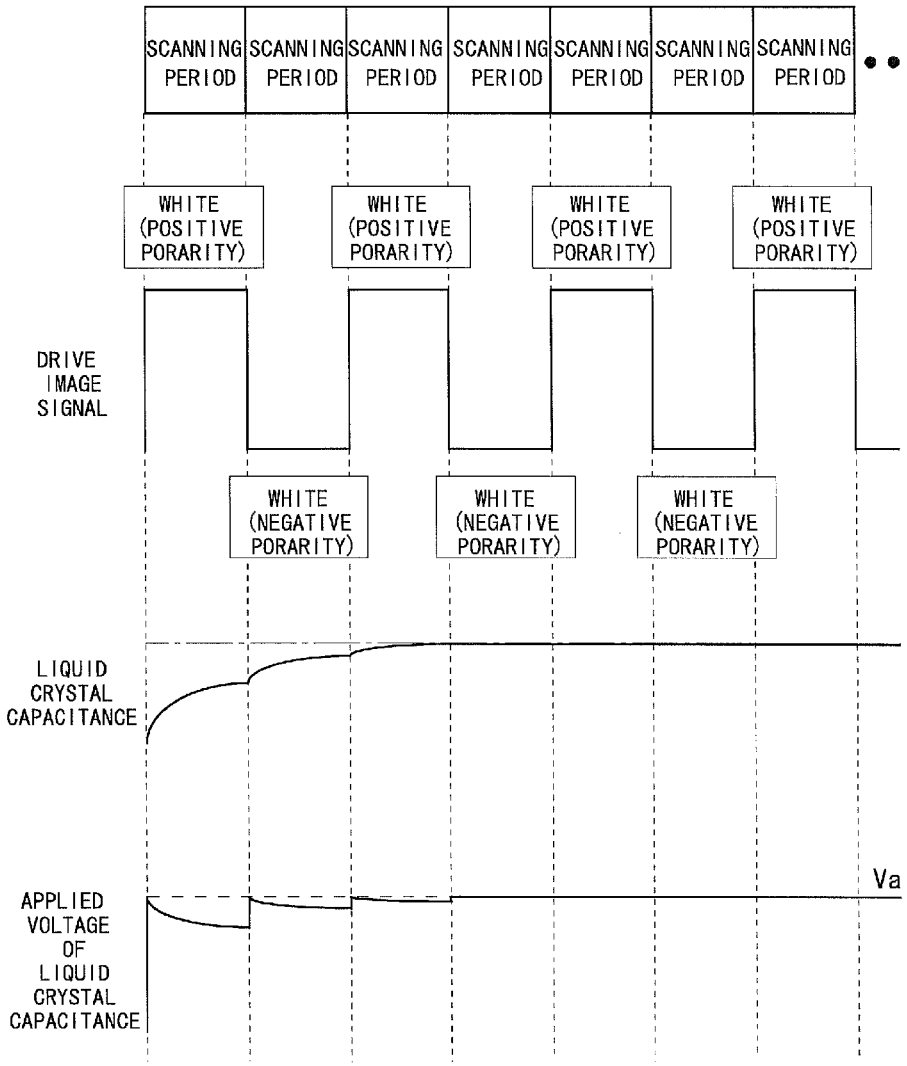
FIG. 14 PRIOR ART
FIG. 14 is one example of a timing chart showing normal drive in a conventional liquid crystal display device.
Figure 15:
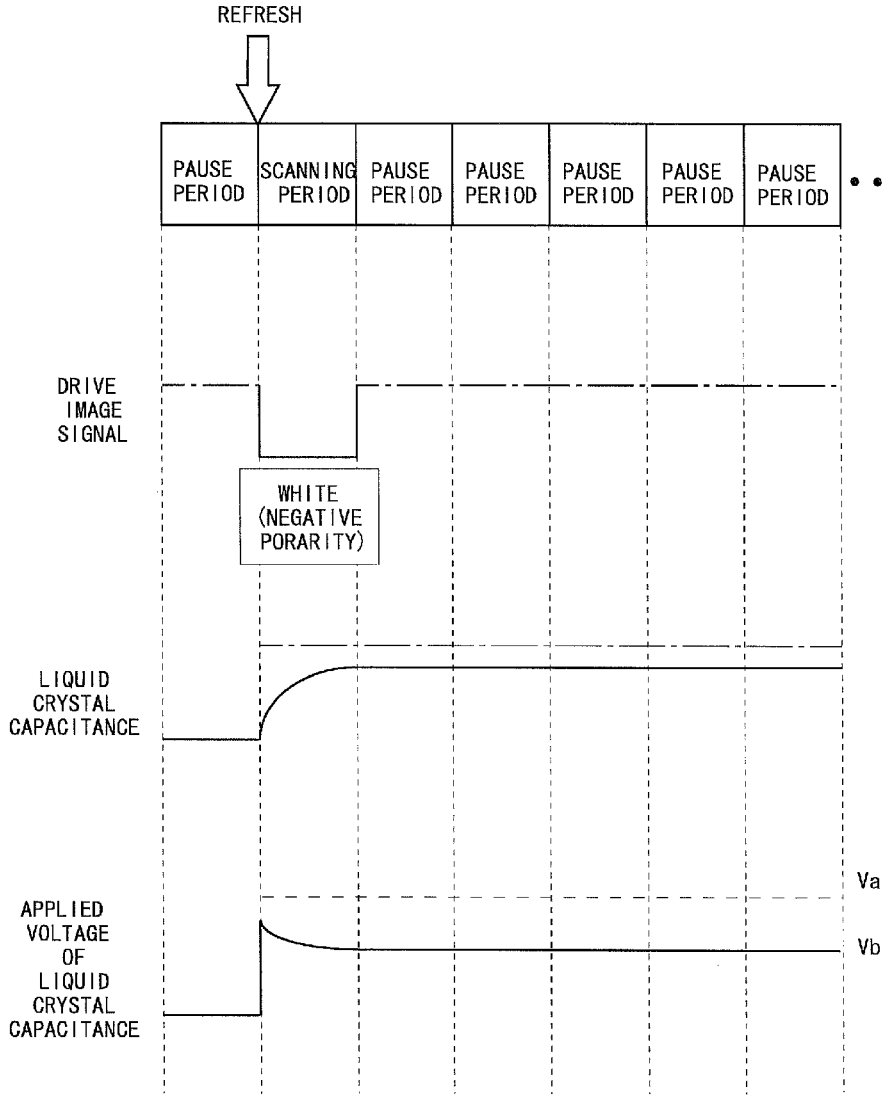
FIG. 15 PRIOR ART
FIG. 15 is one example of a timing chart showing first pause drive in the conventional liquid crystal display device.

FIG. 13 is a diagram for explaining an operation of the liquid crystal display device 2 according to a fourth embodiment of the present invention. It is to be noted that, since the present embodiment is similar to the above first embodiment except for the operation, there will be omitted a block diagram showing the configuration of the liquid crystal display device 2 and the configuration of the display control circuit 200 included in the liquid crystal display device, and descriptions thereof.

5.1 Operation

In the above first to third embodiments, it has been assumed that the updated image data is irregularly transmitted from the host 1 to the liquid crystal display device 2. However, the updated image data may be transmitted regularly from the host 1 in a predetermined cycle. Therefore, in the present embodiment, for example, the updated image data is regularly transmitted in every one second, as shown in FIG. 13. In the first refresh period, first, the first refresh is performed in the first frame, and a refresh pauses in the second frame. Next, the second refresh is performed in the third frame by use of the same image data as the image data used at the first refresh time, and a refresh pauses in the fourth and fifth frames. Then, the third refresh is performed in the sixth frame. When the third refresh is finished, a shift is made to the second refresh period.

In the second refresh period, a refresh pauses in four frames from the seventh frame to the tenth frame, and the fourth refresh is performed in the eleventh frame. Next, a refresh pauses in four frames from the twelfth frame to the fifteenth frame, and the fifth refresh is performed in the sixteenth frame. Subsequently, a refresh pauses in six frames from the seventeenth frame to the twenty-second frame, and the sixth refresh is performed in the twenty-third frame. Hereinafter, in a similar manner, there is made a repetition of performing a refresh and a refresh pause, and the tenth refresh is performed in the fifty-sixth frame, and a refresh pauses in four frames from the fifty-seventh frame to the sixtieth frame.

Since one frame period is 16.67 msec, the frames from the first frame to the sixtieth frame is one second. For this reason, newly updated image data is transmitted from the host 1 in the sixty-first frame. Accordingly, the liquid crystal display device 2 stops a refresh pause having been scheduled in the sixty-first frames, and performs a refresh by use of the newly updated image data in a similar manner to the above case of the first frame to the sixtieth frame. Since updated image data is transmitted from the host 1 in every one second as thus described, a refresh pause, having been scheduled in the sixty-first frame in the second refresh period, is stopped each time, and a refresh is repeated in a similar manner to the above case of the first frame to the sixtieth frame.

It is to be noted that in the present embodiment, it has been assumed that the updated image data is transmitted from the host 1 in every one second. However, this is not restrictive, and for example, the interval of transmission of the updated image data from the host 1 may be longer or shorter than one second. Further, the refresh rates in the first and second refresh period may be appropriately changed in a similar manner to the cases of the above first to third embodiments.

5.2 Effect

According to the present embodiment, even when the updated image data is regularly transmitted from the host 1 in a predetermined cycle, it is possible to finish in a short time the first refresh period for performing three times of refreshes required for making an afterimage at the refresh time visually unrecognizable, and lower the refresh rate in stages. Thereby, the liquid crystal display device 2 can achieve the same effect as in the case of the first embodiment.

6. Others

In each of the above embodiments and modified examples, the case of reversing the polarity in every one frame has been described, but the manner in which the polarity is reversed is not restricted thereto, and for example, the polarity may be reversed in every two frames or three frames.

The present invention is applicable to a liquid crystal display device that displays an image by pause drive.

DESCRIPTION OF REFERENCE CHARACTERS

1: Host
2: Liquid Crystal Display Device
100: Display Portion
110: Pixel Formation Portion
111: TFT (Thin-Film Transistor)
200: Display Control Circuit
220: Command Register
230: Timing Generator
240: Latch Circuit
280: Frame Memory (RAM)
300: Signal Line Drive Circuit
400: Scanning Line Drive Circuit
SL: Signal Line
GL: Scanning Line

The invention claimed is:

1. A liquid crystal display device which performs pause drive at a target refresh rate, the liquid crystal display device comprising:

a display including a plurality of pixel formation portions;

a driver that drives the display; and a display controller that controls the driver based on data received from an outside of the liquid crystal display device, wherein at a pause drive time until a target refresh rate is reached, a refresh is performed in divided periods of: a first refresh period in which a refresh is performed at least three times, and a second refresh period in which an additional refresh is performed while increasing a number of frames in a non-refresh period from a refresh rate at an end of the first refresh period until the refresh rate becomes the target refresh rate, the second refresh period is finished when the refresh rate in the second refresh period reaches the target refresh rate, and the pause drive is continued at the target refresh rate after the second refresh period; and an amount of change in a number of non-refresh frames in the second refresh period is larger than an amount of change in a number of non-refresh frames in the first refresh period.

2. The liquid crystal display device according to claim 1, wherein the second refresh period includes more than one of the additional refreshes.

3. The liquid crystal display device according to claim 2, wherein the number of non-refresh frames in the second refresh period is increased in arithmetic progression with a common difference of not smaller than 2.

4. The liquid crystal display device according to claim 2, wherein the number of non-refresh frames in the second refresh period is increased in geometric progression with a common ratio of not smaller than 2.

5. The liquid crystal display device according to claim 1, wherein the second refresh period includes only one additional refresh performed at the same refresh rate as the target refresh rate.

6. The liquid crystal display device according to claim 1, wherein at least one non-refresh frame is provided in a non-refresh period between respective ones of the at least three refreshes in the first refresh period.

7. The liquid crystal display device according to claim 6, wherein a number of the non-refresh frames in the first refresh period is increased in every non-refresh period in arithmetic progression with a common difference of not smaller than 1.

8. The liquid crystal display device according to claim 6, wherein a number of the non-refresh frames in each non-refresh period in the first refresh period is the same.

9. The liquid crystal display device according to claim 1, wherein the display controller performs Alternating Current drive, and in a whole period of the first refresh period and the second refresh period, a positive polarity period made up of a refresh period performing a refresh with positive polarity and a non-refresh period immediately after the refresh period and a negative polarity period made up of a refresh period performing a refresh with negative polarity and a non-refresh period immediately after the refresh period are provided in approximately the same proportion.

10. The liquid crystal display device according to claim 1, wherein the display controller stops a refresh and a refresh pause when receiving the updated data within the first refresh period or the second refresh period, and newly performs a refresh from the first refresh period by using the updated data.

11. The liquid crystal display device according to claim 10, wherein the data is data irregularly received by the display controller from the outside.

12. The liquid crystal display device according to claim 10, wherein the data is data regularly received from the outside in a predetermined cycle.

13. The liquid crystal display device according to claim 1, wherein the pixel formation portion includes a thin-film transistor including a control terminal connected to a scanning line in the display, a first conduction terminal connected to a signal line in the display, a second conduction terminal connected to a pixel electrode in the display, which is to be applied with a voltage in accordance with an image to be displayed, and a channel layer made of an oxide semiconductor.

14. The liquid crystal display device according to claim 13, wherein the oxide semiconductor is InGaZnOx mainly made of indium (In), gallium (Ga), zinc (Zn) and oxygen (O).

15. A method for driving a liquid crystal display device which includes a display including a plurality of pixel formation portions, a driver that drives the display, and a display controller that controls the driver based on data received from an outside of the liquid crystal display, the liquid crystal display device performing a pause drive at a target refresh rate, the method comprising the steps of:

performing a refresh at least three times in a first refresh period at a pause drive time until a target refresh rate is reached;

performing an additional refresh while increasing a number of frames in a non-refresh period until the refresh rate becomes the target refresh rate in a second refresh period after an end of the first refresh period;

finishing the second refresh period when the refresh rate in the second refresh period reaches the target refresh rate, then continuing the pause drive at the target refresh rate; and the step of performing the additional refresh in the second refresh period includes refreshing such that an amount of change in a number of non-refresh frames in the second refresh period becomes larger than an amount of charge in a number of non-refresh frames in the first refresh period.

* * * * *